US006653794B2

(12) United States Patent
Sagano et al.

(10) Patent No.: US 6,653,794 B2
(45) Date of Patent: Nov. 25, 2003

(54) IMAGE DISPLAY DEVICE AND METHOD OF DRIVING IMAGE DISPLAY DEVICE

(75) Inventors: Osamu Sagano, Tokyo (JP); Naoto Abe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 09/988,449

(22) Filed: Nov. 20, 2001

(65) Prior Publication Data

US 2002/0060525 A1 May 23, 2002

(30) Foreign Application Priority Data

Nov. 21, 2000 (JP) ..... 2000-354836

(51) Int. Cl.[7] ..... G09G 3/10

(52) U.S. Cl. ..... 315/169.2; 345/55; 345/76

(58) Field of Search ..... 315/169.2, 169.3, 315/169.1; 313/495, 496, 497; 345/204, 214, 44, 45, 55, 76, 77

(56) References Cited

U.S. PATENT DOCUMENTS

| | | | | | |
|---|---|---|---|---|---|
| 4,904,895 | A | | 2/1990 | Tsukamoto et al. | 313/336 |
| 5,066,883 | A | | 11/1991 | Yoshioka et al. | 313/309 |
| 5,569,974 | A | | 10/1996 | Morikawa et al. | 313/310 |
| 5,627,436 | A | * | 5/1997 | Suzuki et al. | 315/169.1 |
| 5,654,607 | A | * | 8/1997 | Yamaguchi et al. | 313/495 |
| 5,682,085 | A | | 10/1997 | Suzuki et al. | 315/169.1 |
| 5,734,361 | A | * | 3/1998 | Suzuki et al. | 345/74.1 |
| 6,140,985 | A | * | 10/2000 | Kanai et al. | 345/74.1 |
| 2002/0154101 | A1 | * | 10/2002 | Abe et al. | 345/204 |

FOREIGN PATENT DOCUMENTS

| | | |
|---|---|---|
| JP | 2-257551 | 10/1990 |
| JP | 3-55738 | 3/1991 |
| JP | 4-28137 | 1/1992 |
| JP | 7-181916 | 7/1995 |

OTHER PUBLICATIONS

R. Meyer, et al., *Recent Development on "Microtips" Display at Leti*, Technical Digest of IVMC 91 Nagahama (1991) pp. 6–9.

W.P. Dyke, et al.,*Advances in Electronics and Electron Physics*, vol. 3, Academic Press Inc., New York (1956) pp. 90–184.

C.A. Spindt, et al., *Physical Properties of Thin–film Emission Cathodes with Molybdenum Cones*, Journal of Applied Physics, vol. 47, No. 12, (1976) pp. 5248–5263.

H. Araki et al., *Electroforming and Electron Emission of Carbon Thin Films*, (1981) pp. 22–29 (English Abstract on p. 22).

M. Hartwell et al., *Strong Electron Emission From Patterned Tin–Indium Oxide Thin Films*, International Electron Devices Meeting, Washington, D.C. (1975) pp. 519–521.

M.I. Elinson et al., *The Emission of Hot Electrons and the Field Emissions of Electrons from Tin Oxide*, Radio Engineering and Electronic Physics (1965), pp. 1290–1296.

C.A. Mead, *Operation of Tunnel–Emission Devices*, Journal of Applied Physics, vol. 32 (1961) pp. 646–652.

G. Dittmer, *Electrical Conduction and Electron Emission of Discontinuous Thin Films*, Thin Solid Films, vol. 9 (1972) pp. 317–328.

* cited by examiner

*Primary Examiner*—Don Wong
*Assistant Examiner*—Thuy Vinh Tran
(74) *Attorney, Agent, or Firm*—Fitzpatrick, Cella, Harper & Scinto

(57) ABSTRACT

A gradation characteristic high in contrast without degrading the gradation is realized. In order to achieve this, an image display device is provided that includes: a display panel, in which (m×n) cold cathode devices are connected in matrix by m row wirings and n column wirings, a scan unit connected to the row wirings, a modulation unit connected to the column wirings, light emitting unit disposed at positions opposite to the cold cathode devices, an M-bit voltage amplitude modulation unit; and a pulse width limiting unit are disposed with respect to the M-bit image data as the modulation unit.

25 Claims, 20 Drawing Sheets

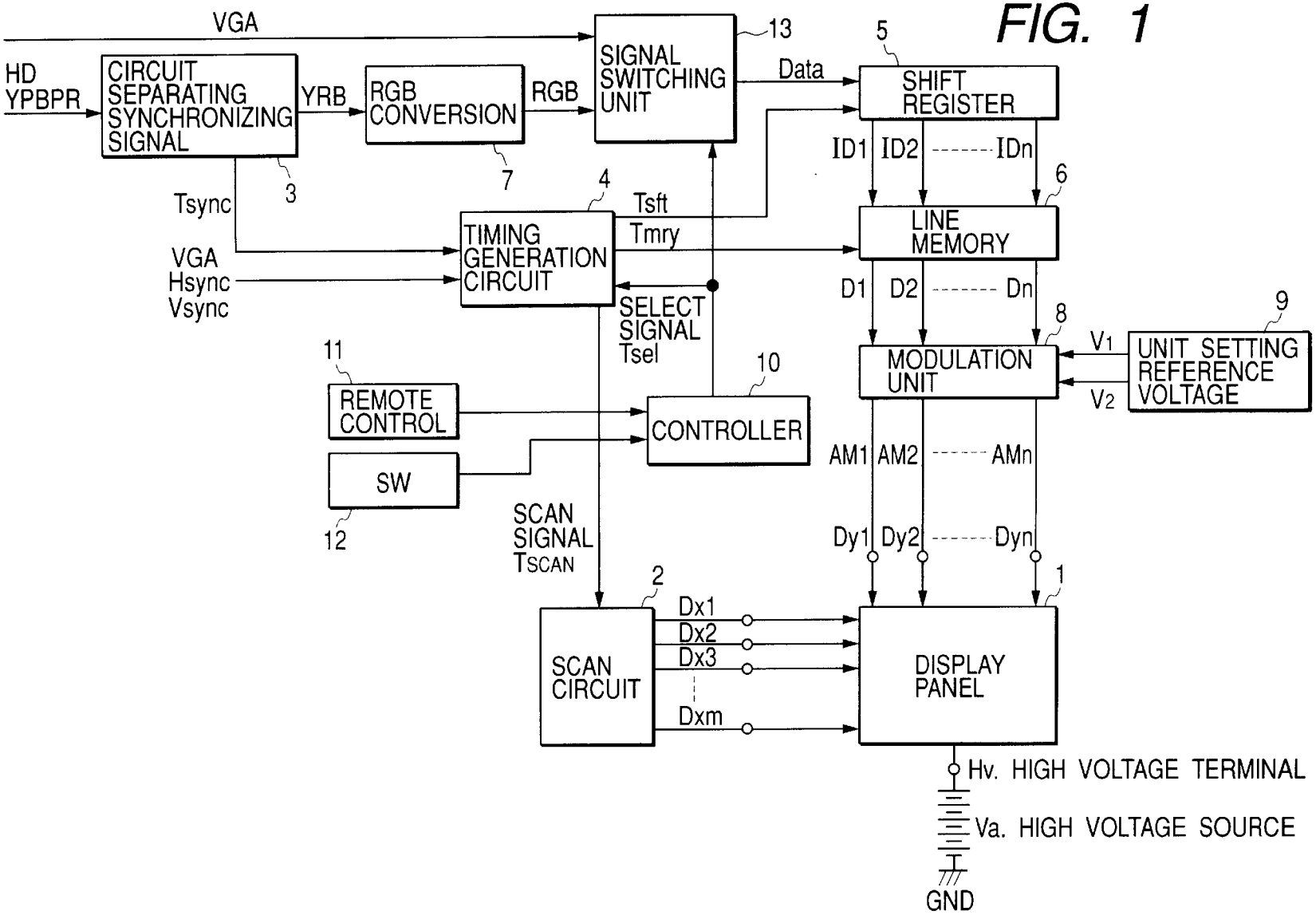
FIG. 1
HD
YPBPR
VGA
CIRCUIT SEPARATING SYNCHRONIZING SIGNAL
3
YRB
RGB CONVERSION
7
RGB
SIGNAL SWITCHING UNIT
13
Data
SHIFT REGISTER
5
ID1
ID2
IDn
LINE MEMORY
6
D1
D2
Dn
MODULATION UNIT
8
AM1
AM2
AMn
UNIT SETTING REFERENCE VOLTAGE
9
V1
V2
Dy1
Dy2
Dyn
DISPLAY PANEL
1
Hv. HIGH VOLTAGE TERMINAL
Va. HIGH VOLTAGE SOURCE
GND
Tsync
VGA Hsync Vsync
TIMING GENERATION CIRCUIT
4
Tsft
Tmry
SELECT SIGNAL Tsel
CONTROLLER
10
REMOTE CONTROL
11
SW
12
SCAN SIGNAL TSCAN
SCAN CIRCUIT
2
Dx1
Dx2
Dx3
Dxm

IMAGE DISPLAY DEVICE AND METHOD OF DRIVING IMAGE DISPLAY DEVICE

BACKGROUND OF THE INVENTION

Field of the Invention

The present invention relates to an image display device having a display panel in which a plurality of cold cathode devices are arranged in matrix.

Related Background Art

Up to now, there have been known two kinds of electron emitting devices, that is, a hot cathode device and a cold cathode device. In the cold cathode device among them, there have been known, for example, a surface conduction electron emitting device, a field emission device (hereinafter referred to as "FE"), a metal/insulator/metal electron emitting device (hereinafter referred to as "MIM"), and the like.

As the surface conduction electron emitting device, there have been known, for example, M. I. Elinson, Radio Eng. Electron Phys., 10, 1290, (1965), and other examples that will be described later. The surface conduction electron emitting device is so designed as to use a phenomenon in which a current is allowed to flow in parallel with a film surface on a thin film of a small area formed on a substrate to cause electron emission. As the surface conduction electron emitting device, there have been reported the above-mentioned electron emitting device using $SnO_2$ thin film by Elinson et al., as well as an electron emitting device using an Au thin film (G. Dittmer: "Thin Solid Films", 9, 317 (1972), an electron emitting device using an $In_2O_3/SnO_2$ thin film (M. Hartwell and C. G. Fonstad: "IEEE Trans. ED Conf.", 519 (1975)), an electron emitting device using a carbon thin film (Hisashi Araki, et al.: Vacuum, Vol. 26, No. 1, 22 (1983)), and the like.

As a typical example of the device structure of those surface conduction electron emitting devices, a plan view of the above-mentioned device by M. Hartwell, et al. is shown in FIG. 19. In the figure, reference numeral 3001 denotes a substrate; and 3004 is an electroconductive thin film made of a metal oxide formed through sputtering. The electroconductive thin film 3004 is formed into an H-shaped plane as shown in the figure. The electroconductive film 3004 is subjected to energization called "energization forming" which will be described later, to thereby form an electron emitting portion 3005. In the figure, an interval L is set to 0.5 to 1 mm, and W is set to 0.1 mm. For convenience of the drawing, the electron emitting portion 3005 is formed into a rectangular shape in the center of the electroconductive thin film 3004, but this is schematic and does not faithfully represent the position and shape of the actual electron emitting portion.

In the above-mentioned surface conduction electron emitting devices including the device proposed by M. Hartwell et al., it is general that the electron emitting portion 3005 is formed by subjecting the electroconductive thin film 3004 to the energization that is called "energization forming" prior to electron emission. That is, the energization forming is that a constant d.c. voltage, or a d.c. voltage that steps up at a very slow rate of, for example, about 1 V/min is applied between both ends of the electroconductive thin film 3004 to energize the electroconductive thin film 3004 to locally destroy, deform or deteriorate the electroconductive thin film 3004, thereby forming the electron emitting portion 3005 which is in an electrically high resistant state. Note that a fissure occurs in a part of the electroconductive thin film 3004 that has been locally destroyed, deformed or deteriorated. In the case where an appropriate voltage is applied to the electroconductive thin film 3004 after the energization forming has been made, electron emission is conducted in the vicinity of the fissure.

Also, as the FE type example, there have been known, for example, W. P. Dyke & W. W. Dolan, "Field emission", Advance in Electron Physics, 8, 89 (1956), and C. A. Spindt, "Physical Properties of thin-film field emission cathodes with molybdenum cones", J. Appl. Phys., 47, 5248 (1976), etc.

As a typical example of the FE type device structure, a cross-sectional view of the above-mentioned device proposed by C. A. Spindt, et al. is shown in FIG. 20. In the figure, reference numeral 3010 denotes a substrate, 3011 is an emitter wiring made of electroconductive material, 3012 is an emitter cone, 3013 is an insulating layer, and 3014 is a gate electrode. This device conducts the electric field electron emission from a leading portion of the emitter cone 3012 by applying an appropriate voltage between the emitter cone 3012 and the gate electrode 3014. Also, as another device structure of the FE type, there is an example in which the emitter and the gate electrode are arranged on the substrate substantially in parallel with the substrate plane instead of the laminate structure shown in FIG. 20.

Also, as the MIM type example, there have been known, for example, C. A. Mead, "Operation of tunnel-emission Devices", J. Appl. Phys., 32, 646 (1961), and the like. A typical example of the device structure of the MIM type is shown in FIG. 21. The figure is a cross-sectional view in which reference numeral 3020 denotes a substrate, 3021 denotes a lower electrode made of metal, 3022 denotes a thin insulating layer having a thickness of about 100 Å, 3023 denotes an upper electrode made of metal having a thickness of about 80 to 300 Å. In the MIM type, an appropriate voltage is applied between the upper electrode 3023 and the lower electrode 3021 to conduct the electron emission from the surface of the upper electrode 3023.

The above-mentioned cold cathode device requires no heater for heating because the electron emission can be obtained at a low temperature as compared with the hot cathode device. Therefore, the cold cathode device is simpler in structure than the hot cathode device, and a fine device can be prepared. Also, it is difficult that a problem such as the heat melting of the substrate occurs even if a large number of devices are arranged on the substrate with a high density. Also, because the hot cathode device operates due to the heat from the heater, there is an advantage in that a response speed is high in case of the cold cathode device which is different from the low response speed. For that reason, a study for applying the cold cathode device has been increasingly conducted.

For example, the surface conduction electron emitting device is advantageous in that a large number of devices can be formed over a large area since the device is particularly simple in structure and easy in manufacture among the cold cathode devices. Therefore, as disclosed in Japanese Patent Application Laid-Open No. 64-31332 made by the present applicant, for example, a method in which a large number of devices are arranged for driving has been studied. Also, in the application of the surface conduction electron emitting device, for example, an image forming apparatus such as an image display device or an image recording device, an electric charge beam source and the like have been studied.

In particular, as the application of the surface conduction electron emitting device to the image display device, there has been studied the image display device using the combination of the surface conduction electron emitting device with a phosphor that emits light upon irradiation of an electron beam thereto as disclosed in, for example, U.S. Pat. No. 5,066,883, Japanese Patent Application Laid-Open No. 2-257551 and Japanese Patent Application Laid-Open No. 4-28137 made by the present applicant. The image display device using the combination of the surface conduction electron emitting device with the phosphor is expected to have the characteristics superior to that of the image display device of other conventional systems. For example, it can be said that such an image display device is superior to a liquid crystal display device that has been spread in recent years in view of the fact that backlight is not required because of a self light emitting type and the fact that an angle of visibility is wide.

Also, a method in which a large number of FE devices are arranged for driving is disclosed in, for example, U.S. Pat. No. 4,904,895 made by the present applicant. Also, as an example of applying the FE device to the image display device, there has been known a plate display device that has been reported by, for example, R. Meyer, et al. (R. Meyer: "Recent Development on Microtips Display at LETI", Tech. Digest of fourth Int. Vacuum Microelectronics Conf., Nagahama, pp. 6 to 9 (1991)). Also, an example in which a large number of MIM devices are arranged and applied to the image display device is disclosed in, for example, Japanese Pat. Application Laid-Open No. 3-55738 made by the present applicant.

The above-mentioned cold cathode device has the following three characteristics with respect to the emission current Ie.

First, when a voltage equal to or higher than a given voltage (called "threshold voltage Vth") is applied to the device, the emission current Ie rapidly increases, whereas in the case where a voltage lower than the threshold voltage Vth is applied to the device, the emission current Ie is hardly detected. That is, the cold cathode device is a non-linear device having a definite threshold voltage Vth with respect to the emission current Ie.

Second, because the emission current Ie changes depending on a voltage Vf that is applied to the device, the magnitude of the emission current Ie can be controlled by the voltage Vf.

Third, the response speed of the current Ie emitted from the device with respect to the voltage Vf that is applied to the device is high.

Because the cold cathode device has the above-mentioned characteristics, the combination of the cold cathode device with the phosphor can be preferably employed for the display device.

For example, in the display device in which a large number of devices are disposed in correspondence with the pixels of the display panel as shown in FIG. 10, if the above-mentioned first characteristic is used, the display screen is sequentially scanned so as to conduct display. That is, a voltage equal to or higher than the threshold voltage Vth is appropriately applied to the device that is being driven in accordance with a desired light emitting luminance, and a voltage lower than the threshold voltage Vth is applied to the devices that are in a non-selected state. If the device to be driven is sequentially changed over, the display can be conducted by sequentially scanning the display screen.

Also, if the above-mentioned second characteristic is utilized to change the voltage Vf that is applied to the device, the amount of emitted electrons can be controlled, thereby being capable of controlling the light emission luminance of the phosphor and conducting the image display.

Further, through the above-mentioned third characteristic, the amount of charges of electrons emitted from the device can be controlled by a duration of time during which the voltage Vf is applied.

A method in which the value of voltage that is applied to the cold cathode device is modulated by using the above-mentioned second characteristic to control the amount of emission electrons for displaying the image is disclosed in, for example, Japanese Patent Application Laid-Open No. 11-288246 made by the present applicant.

Also, an example in which image data M bits (M=K+L) is divided into K-bit data and L-bit data, the K bits are modulated in pulse width and the L bits are modulated in amplitude to display the image is disclosed in Japanese Patent Application Laid-Open No. 7-181916 made by Futaba Denshi Kogyo K. K.

The subject matter of the present invention resides in that the image display is conducted by using the above-mentioned second characteristic of the cold cathode device, and as a result of the zealous study by the present inventors, there arise the following problems.

The present inventors have tried the electron emitting devices of various materials, manufacturing methods and structures including the above-mentioned conventional devices. In addition, the present inventors have studied the multi electron beam source in which a large number of electron emitting devices are arranged, and the image display device to which the multi electron source is applied. The present inventors have tried the multi electron beam source made by an electric wiring method shown in, for example, FIG. 22, that is, a multi electron beam source in which a large number of electron emitting devices are arranged two-dimensionally, and those devices are wired in matrix as shown in the figure.

In the figure, reference numeral 4001 schematically shows electron emitting devices, 4002 is row wirings, and 4003 is column wirings. The row wirings 4002 and the column wirings 4003 have finite electric resistors in fact, and in the figure, the electric resistors are shown as wiring resistors 4004 and 4005. The above-mentioned wiring method is called "passive matrix". Note that, for the convenience of the drawing, a 6×6 matrix is shown, but the scale of the matrix is not limited to this, for example, in case of the multi electron beam source for the image display device, a number of devices sufficient to conduct a desired image display are arranged and wired.

In the multi electron beam source in which the electron emitting devices are arranged in the passive matrix, in order to output a desired electron beam, appropriate electric signals are supplied to the row wirings 4002 and the column wirings 4003. For example, in order to drive the electron emitting devices on one arbitrary line of the matrix, a selection voltage Vs is applied to the row wiring 4002 of a selected row, and at the same time, a non-selection voltage Vns is applied to the row wiring 4002 on the non-selected rows. In synchronism with those signals, a driving voltage Ve for outputting the electron beam is applied to the column wirings 4003. According to this method, if the voltage drops due to the wirings resistors 4004 and 4005 are ignored, a voltage of Ve−Vs is applied to the electron emitting device on the selected row, and a voltage of Ve−Vns is applied to the electron emitting devices on the non-selected rows. If Ve, Vs and Vns are set to the voltage of the appropriate magnitude, the electron beam of a desired intensity should be outputted from only the electron emitting device on the selected row, and if the different driving voltages Ve are applied to the respective column wirings, the electron beams of different intensities should be outputted from the respective devices on the selected line (the above characteristic is called "voltage amplitude modifying characteristic"). Therefore, there are proposed various intended uses of the multi electron beam source in which the electron emitting devices are wired in passive matrix, and for example, if a voltage signal in accordance with the image information is appropriately applied, it is expected that such a multi electron beam source can be applied as the electron source for the image display device.

However, the image display device that has been tried by the present inventors in advance suffers from the following problems.

In the conventional broadcast system, when an image is displayed on a CRT (cathode ray tube), because the input/output characteristic of the CRT has the characteristic that emits light of luminance proportional to input data to the power of 2.2 (this is called "inverse γ characteristic"), a broadcasting station side subjects image-taking data to the 0.45th power conversion (called "γ conversion") and thereafter transmits the data in order to set the relationship of the taken image and the final display image to 1:1.

On the other hand, the image display device according to the present invention uses not the CRT but a display panel in which the cold cathode devices are arranged in matrix as the display panel.

Up to now, as a result that the present inventors have studied the input/output characteristic of the display panel according to the present invention, in the case where the driving voltage Ve that is applied to the cold cathode device is set in accordance with the input image data as shown in FIG. 23, there have been found that the display panel has a light emitting characteristic close to the inverse γ characteristic (2.2nd power) of the CRT as shown in FIG. 24. In FIG. 24, the number of bits of the image data is represented by 8 bits.

If this excellent characteristic is used, there is normally an excellent advantage that in order to emit light of the luminance proportional to the input image data to the 2.2nd power, no inverse γ conversion is required by using a lookup table as in a display having the linear light emitting characteristic with respect to the input image data such as a PDP (plasma display). When the inverse γ conversion is conducted by using the lookup table, there generally arises such a problem that a round error occurs due to the lookup table, and a gradation at a low gradation portion is particularly erased.

On the other hand, in the display using the cold cathode device according to the present invention, because no lookup table is employed, there is an advantage that the output can represent the same number of gradations as that of the input image data due to the inverse γ characteristic of the cold cathode device if the magnitude of the driving voltage Ve is modulated linearly with respect to the number of gradations of the input image data without erasing the gradation.

Therefore, as a result that the present inventors have further studied the input/output characteristic of the display panel according to the present invention, they have found that, in the case where a voltage is set as shown in FIG. 23, the output luminance with respect to the input image data has the characteristic close to the inverse γ characteristic of about the 2.2nd power, but the output luminance does not always coincide with the input image data in a portion where the input image data is small (low gradation portion), and in the case where the input image data is 0 (applied voltage−Vs+VL), there is a phenomenon in which the light emitting luminance does not become 0. As a result, there arises such a problem that the contrast is decreased because the luminance of the dark portion slightly rises.

SUMMARY OF THE INVENTION

The present invention has been made for solving the above-mentioned problems with the conventional devices, and therefore an object of the present invention is to realize an excellent gradation characteristic which is high in contrast and does not erase the gradation by using a display device other than a CRT.

The following invention has been devised as a result of intensive efforts by the present inventors to solve the above-mentioned problems.

That is, according to the present invention, there is provided a first image display device characterized in that the device comprises:

a display panel in which (m×n) surface conduction electron emitting devices are connected in matrix by m row wirings and n column wirings;

scan means connected to the row wirings;

modulation means connected to the column wirings; and light emitting means disposed at positions opposite to the cold cathode devices; and that the modulation means includes M-bit voltage amplitude modulation means and pulse width limiting means for an image data of M bits, and a modulation signal that is supplied to the surface conduction electron emitting devices is a voltage signal having an amplitude and a pulse width corresponding to image data.

Here, it is preferable that based on a predetermined threshold value, the modulation means modulates only the amplitude of a modulation signal for the image data equal to or higher than a threshold value, and modulates only the pulse width or both of the amplitude and the pulse width of the modulation signal for the image data lower than the threshold value.

Further, according to the present invention, there is provided a second image display device characterized in that the device comprises:

a display panel in which (m×n) surface conduction electron emitting devices are connected in matrix by m row wirings and n column wirings;

scan means connected to the row wirings;

modulation means connected to the column wirings; and light emitting means disposed at positions opposite to the cold cathode devices; and that the modulation means is amplitude modulation means having a non-linear input/output characteristic when applied to the input image data.

The amplitude modulation means is characterized in that the means has K threshold values $D_1$ to $D_K$ (where $D_1 < D_2 < \ldots < D_K$, and K is an integer of 1 or more) for, for example, input image data Data, and has a stepped characteristic having:

a first inclination at $0 \leqq \text{Data} < D_1$;

a second inclination at $D_1 \leqq \text{Data} < D_2$;

a K-th inclination at $D_{K-1} \leqq \text{Data} < D_K$; and a (K+l)-th inclination at $D_K \leqq \text{Data}$.

Note that the above-mentioned first image display device is definitely different from the device disclosed in Japanese Patent Application Laid-Open No. 7-181916 described in the conventional example.

In other words, in the above-mentioned conventional example, K bits are modulated in pulse width with respect to the image data of M bits (M=K+L), and the L bits are modulated by voltage amplitude modulation, to thereby obtain the gradation characteristic of M bits. On the contrary, in the image display device according to the present invention, modulation is conducted by the voltage amplitude modulation means of M bits, and the pulse width is limited in an auxiliary manner for a lower gradation portion, which does not accord with the inverse γ characteristic of the 2.2nd power, to provide the 2.2nd power characteristic.

According to the above-mentioned image display device of the present invention, there is an advantage in that not only a high contrast can be realized but also an excellent gradation characteristic without erasing the gradation can be realized.

BRIEF DESCRIPTION OF THE DRAWINGS

These and other objects and advantages of this invention will become more fully apparent from the following detailed description taken with the accompanying drawings in which:

FIG. 1 is a block diagram showing an image display device in accordance with an embodiment of the present invention;

DETAILED DESCRIPTION OF THE PREFERRED EMBODIMENTS

Hereinafter, a description will be given in more detail of embodiments of the present invention with reference to the accompanying drawings.

First Embodiment

A first embodiment is directed to an example in which in a display device having a large number of cold cathode devices, in order to display an image high in gradation and high in contrast, not only the amplitude of a driving voltage that is applied to a cold cathode device is modulated, but also auxiliary modulation of the pulse width is added in an auxiliary manner.

Figure 10:
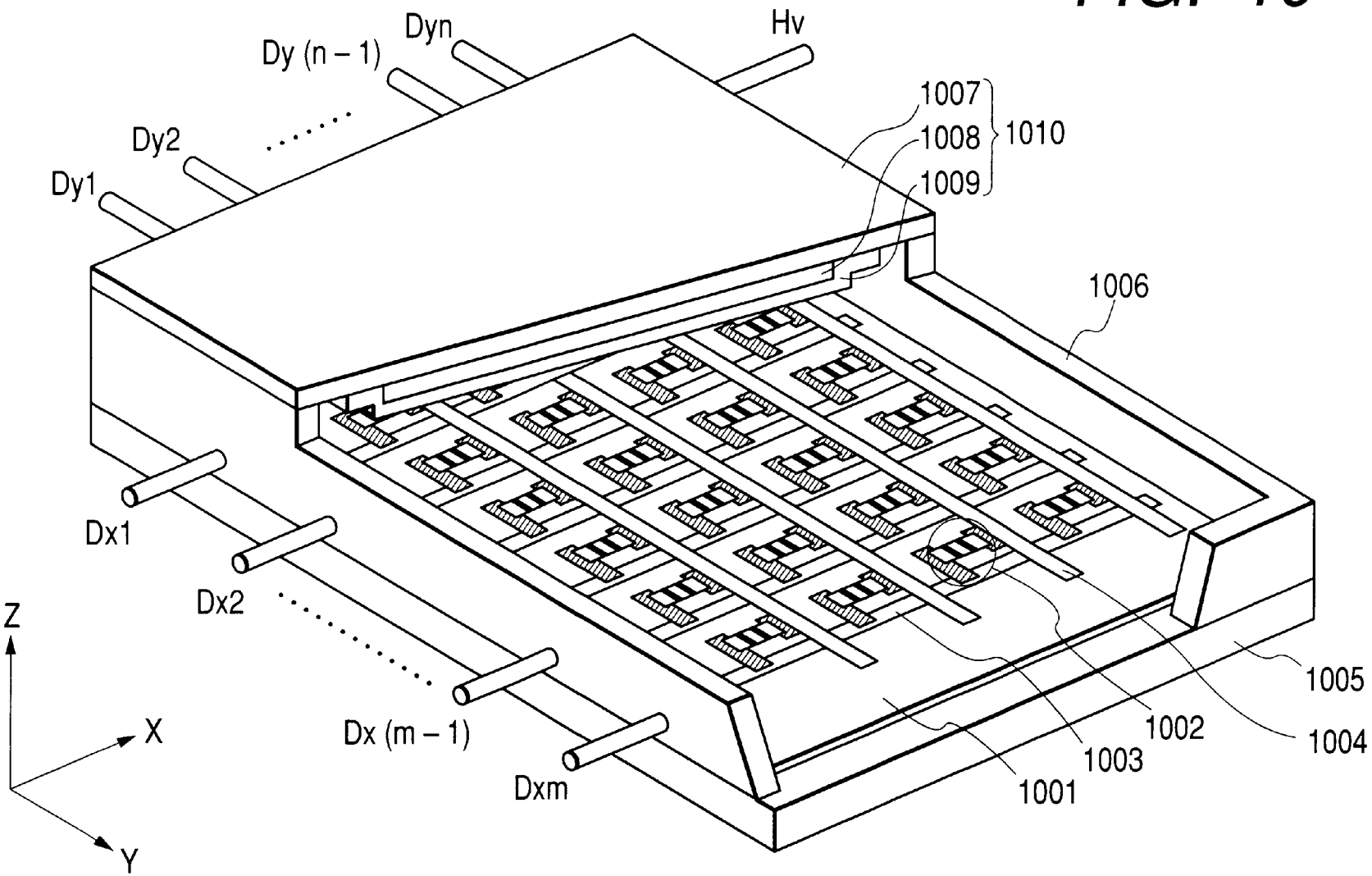
FIG. 10 is a diagram for explanation of an electric connection of a display panel used in the embodiment of the present invention.

FIG. 10 is a perspective view showing a display panel used in this embodiment in which a part of the panel is cut off in order to show the internal structure. In the figure, reference numeral 1005 denotes a rear plate, 1006 is a side wall, 1007 is a face plate, and those members 1005 to 1007 form an airtight vessel for maintaining the internal of the display panel in a vacuum state. In assembling the airtight vessel, it is necessary to seal the joint portions of the respective members in order to maintain a sufficient strength and airtight property. For example, a flit glass is coated on a joint portion and then burned in an atmosphere or a nitrogen atmosphere at 400 to 500° C. for 10 minutes or longer, to thereby achieve the sealing.

The rear plate 1005 is fixed with a substrate 1001, and n×m cold cathode devices 1002 are formed on the substrate 1001. The n×m cold cathode devices are wired in passive matrix with m row wirings 1003 and n column wirings 1004. The above portion made up of the members 1001 to 1004 is called "multi electron source" in the present specification.

Also, a fluorescent screen 1008 is formed on the lower surface of the face plate 1007. Because this embodiment is directed to a color display device, phosphors of three primary colors consisting of red, green and blue used in the field of the CRT are separately painted on the portion of the fluorescent screen 1008. The phosphors are so structured as to form the pixels at positions that are formed in matrix in correspondence with the respective pixels (picture elements) of the rear plate, onto which the emission electrons (emission current) are irradiated from the cold cathode devices.

In this embodiment, the surface conduction electron emitting device is produced in the display panel having the above-mentioned appearance as the cold cathode device.

Figure 11:
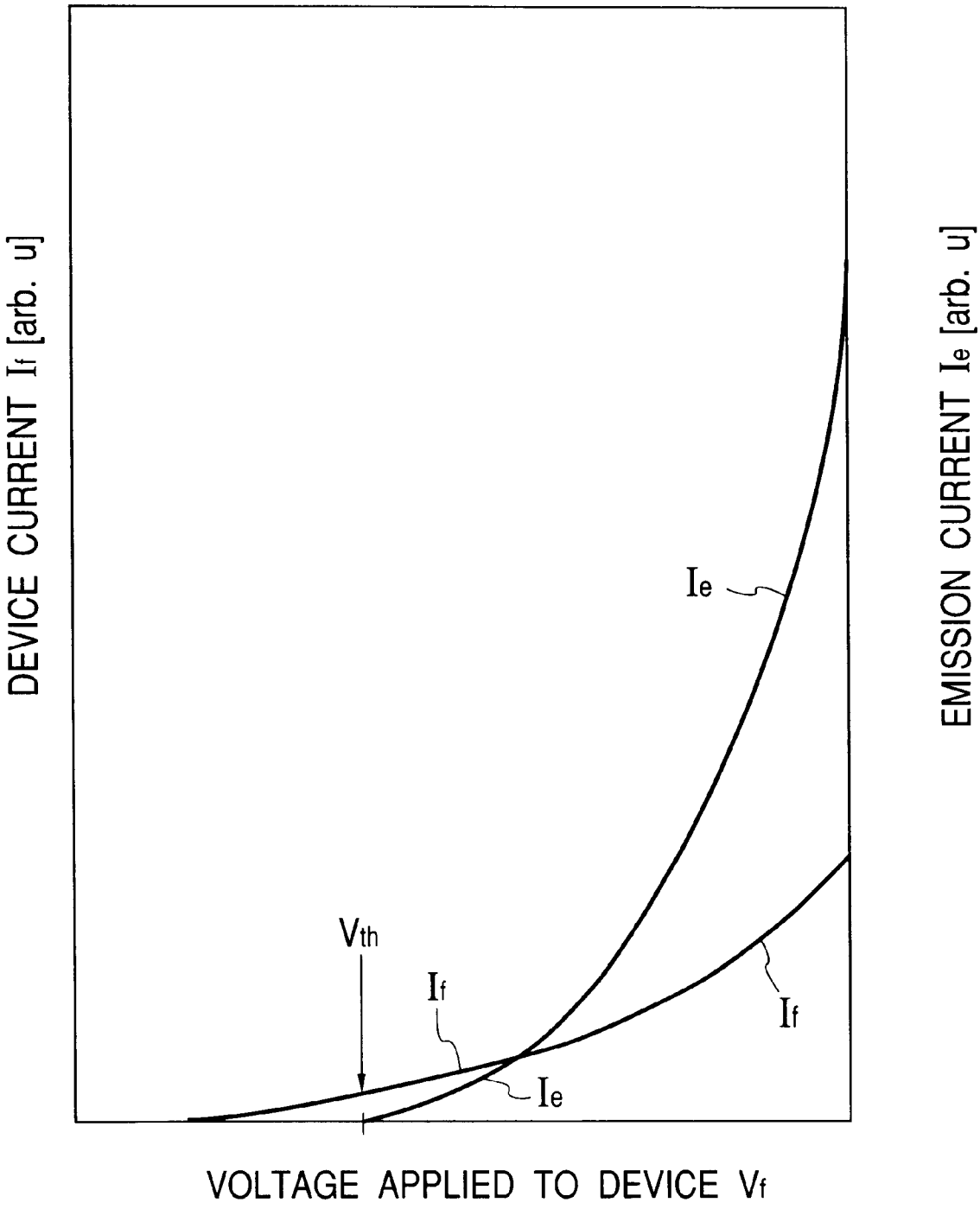
FIG. 11 is a diagram for explanation of the characteristic of a cold cathode device shown in FIG. 10.

The surface conduction electron emitting device has the (emission current Ie) to (voltage applied to device Vf) characteristic and the (device current If) to (voltage applied to device Vf) characteristic as shown in FIG. 11. Because the emission current Ie is extremely small as compared with the device current If, and it is difficult to indicate those currents Ie and If on the same scale, two graphs are shown based on different scales.

In other words, the surface conduction electron emitting device has the following characteristics with respect to the emission current Ie.

First, when a voltage equal to or higher than a given voltage (called "threshold voltage Vth") is applied to the device, the emission current Ie rapidly increases, whereas in the case where a voltage lower than the threshold voltage Vth is applied to the device, the emission current Ie is hardly detected. That is, the surface conduction electron emitting device is a non-linear device having a definite threshold voltage Vth with respect to the emission current Ie.

Second, because the emission current Ie changes depending on a voltage Vf that is applied to the device, the magnitude of the emission current Ie can be controlled by the voltage Vf.

Because the surface conduction electron emitting device has the above-mentioned characteristics, the device can be preferably employed in the display device. For example, in the display device in which a large number of devices are disposed in correspondence with the pixels of the panel as shown in FIG. 10, if the first characteristic is utilized, the display screen can be sequentially scanned to conduct display. That is, a voltage equal to or higher than the threshold voltage Vth is appropriately applied to the device that is being driven in accordance with a desired light emitting luminance, and a voltage lower than the threshold voltage Vth is applied to the devices that are not being selected. If the device to be driven is sequentially changed over, the display can be conducted by sequentially scanning the display screen.

Also, if the above-mentioned second characteristic is utilized, the light emission luminance of the phosphor can be controlled by the voltage Vf that is applied to the device, thereby being capable of conducting the image display.

FIG. 1 is a block diagram showing the outline of a circuit structure of the above-mentioned display device. In the figure, reference numeral 1 denotes a display panel including a multi electron source therein, Dx1 to Dxm are terminals of row wirings of the multi electron source, Dy1 to Dyn are terminals of column wirings of the multi electron source, Hv is a high voltage terminal for applying an acceleration voltage between the face plate and the rear plate, Va is a high voltage source, 2 is a scan circuit, 3 is a synchronizing signal separating circuit, 4 is a timing generation circuit, 7 is a conversion circuit for converting a YRB signal outputted from the synchronizing signal separating circuit 3 into an RGB signal, 13 is a signal switching unit for switching a HD system signal (RBG signal) and a VGA signal, 5 is an shift register for one line of the image data, 6 is a line memory for one line of the image data, 8 is a modulation unit, 9 is a reference voltage setting unit, 10 is a controller, 11 is a remote control interface, and 12 is a switch for controlling the image display device. In this embodiment, the surface conduction electron emitting device is used as the electron emitting device of the multi electron source.

Synchronizing Signal Separating Circuit and Timing Generation Circuit

The image display device according to this embodiment is capable of displaying together a television signal of the HD system and a VGA signal that is an output of a computer or the like. However, this embodiment shows one example, and the image display device can be similarly applied to other standards such as the NTSC, PAL SECAM and the like.

The VGA signal is supplied to the signal switching unit 13, and its synchronizing signals Vsync and Hsync are supplied to the timing generation circuit 4. Also, the HD system television signal is supplied to the timing generation circuit after the synchronizing signals Tsync (including a vertical synchronizing signal and a horizontal synchronizing signal) are separated from the television signal by the synchronizing signal separating circuit 3. Further, the video signal YRB is converted into the digital RGB signal by the RGB conversion circuit 7 before being supplied to the signal switching unit 13. The signal switching unit 13 is a circuit that performs selection between VGA and HD and switches the image source in accordance with a selection signal Tsel from the controller 10. The controller 10 supplies the selection signal Tsel to the respective units when the image source to be selected is set by the switch 12 or the like.

The timing generation circuit 4 determines the operation timings of the respective units in synchronism with the synchronizing signal of the image source selected on the basis of the selection signal Tsel. That is, the timing generation circuit 4 generates signals such as Tsft that controls the operation timing of the shift register 5, Tmry that controls the operation timing of the line memory 6, and Tscan that controls the operation of the scan circuit 2.

Scan Circuit

Figure 2:
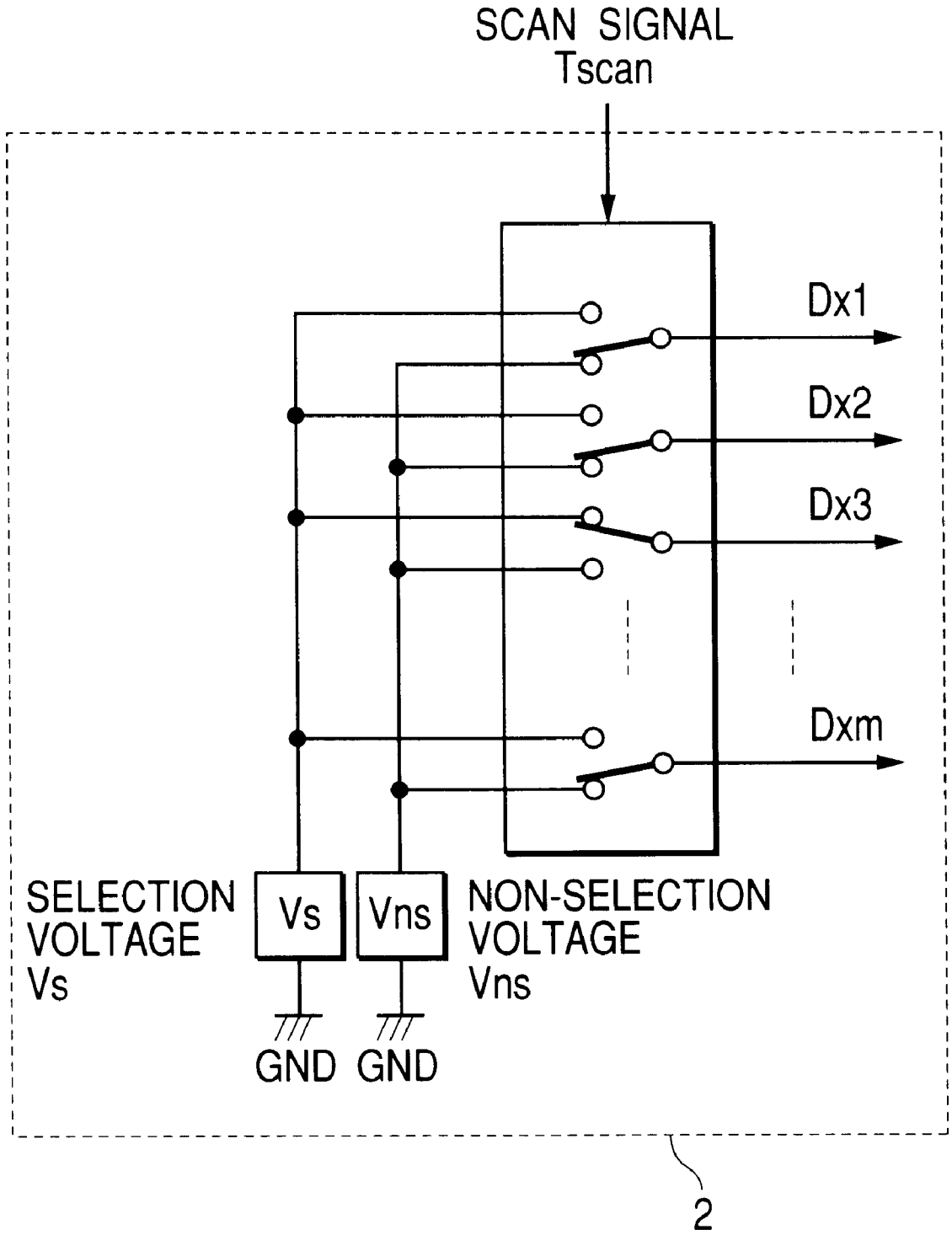
FIG. 2 is a diagram showing an example of a scan circuit in FIG. 1.

The scan circuit 2 is a circuit that outputs a selection voltage Vs or a non-selection voltage Vns to the connection terminals Dxl to Dxm in order to sequentially scan the multi electron source line by line, and for example, as shown in FIG. 2, the scan circuit 2 includes m switches therein. It is preferable that those switches are made up of transistors or FETs.

The magnitudes of the selection voltage Vs and the non-selection voltage Vns outputted from the scan circuit 2, and the magnitude of the modulation signal which will be described later may be determined on the basis of the (Vf to Ie) characteristic and (Vf to If) characteristic of the cold cathode device to be used.

Shift Register and Line Memory

The image data Data separated by the synchronizing signal separating circuit 3 is serial/parallel-converted from serial data format into parallel image data ID1 to IDn for each of the column wirings by the shift register 5, and after the image data Data has been stored in the line memory 6 for one horizontal scan period, it is supplied to the modulation unit as the parallel image data D1 to Dn.

In this embodiment, the image data ID1 to IDn and D1 to Dn are image data of 8 bits.

Also, because the shift register 5, the line memory 6 and the modulation unit 8 require a very large number of signal lines and circuits for each of the column wirings, it is preferable that those units are divided in column directions, and a plurality of integrated circuits each including the shift register, the line memory and the modulation unit with respect to a plurality of column wirings therein are connected to each other.

Modulation Unit According to This Embodiment

Figure 3:
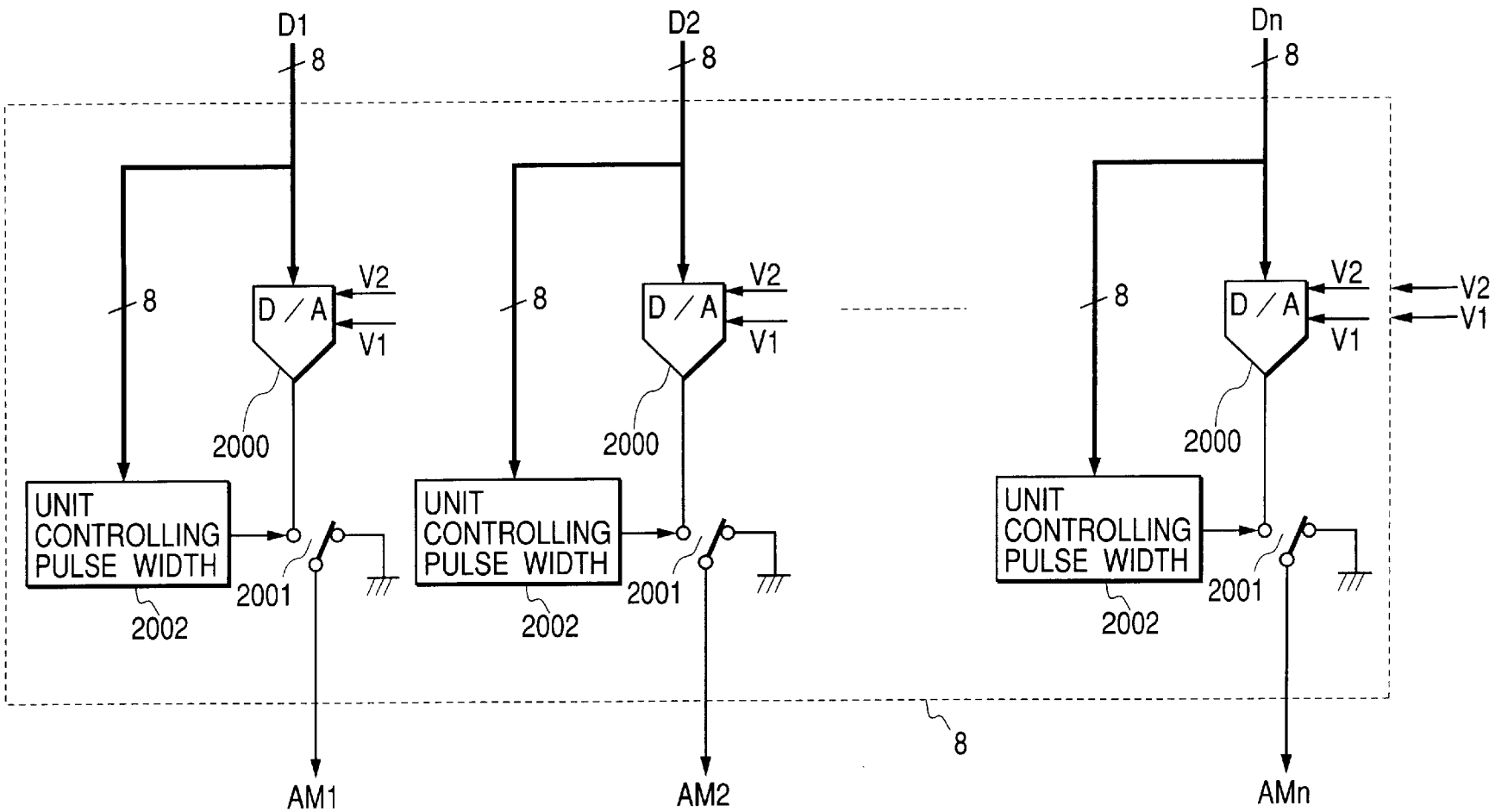
FIG. 3 is a block diagram showing a modulation unit in accordance with a first embodiment of the present invention.

A block diagram showing the modulation unit 8 according to this embodiment is shown in FIG. 3. In the figure, reference numeral 2000 is a D/A converter, 2001 is a switch and 2002 is a pulse width controlling circuit.

The switch 2001 switchingly supplies the output of the D/A converter to the column wirings Dy1 to Dyn of the display panel, or supplies the GND potential on the basis of the control signal from the pulse width controlling circuit 2002.

The D/A converter 2000 is supplied with two reference voltages V1 and V2 from the reference voltage setting circuit 9 as shown in FIGS. 1 and 3.

Figure 4:
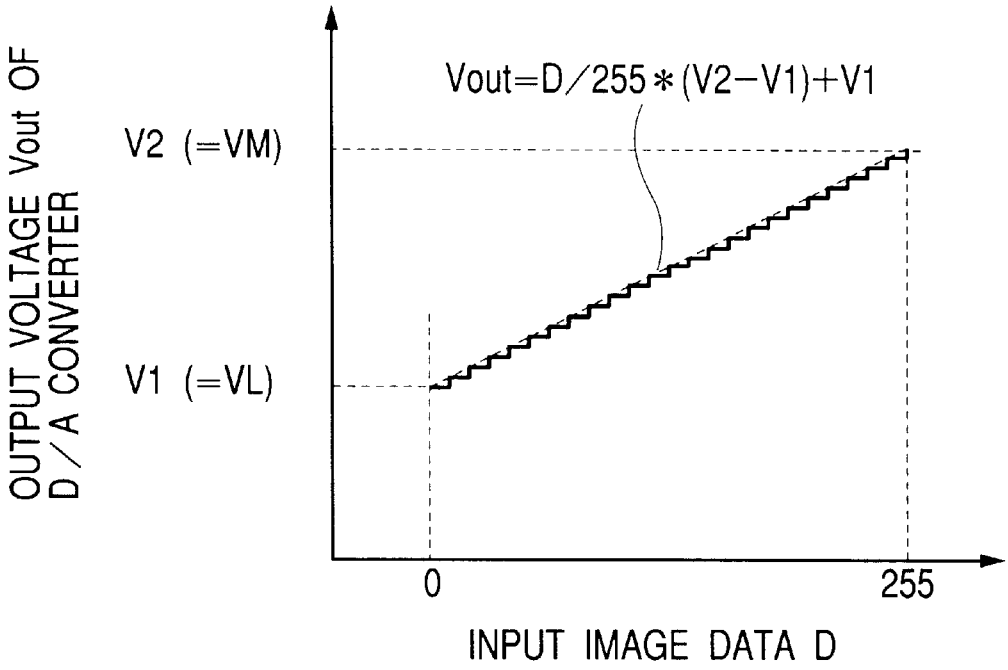
FIG. 4 is a graph showing an input/output characteristic of a D/A converter in accordance with the first embodiment.

The D/A converter 2000 generates an output Vout shown in FIG. 4 in accordance with the input image data. In this embodiment, both of the number of bits of the D/A converter and the number of bits of the image signal are 8 bits.

Figure 5:
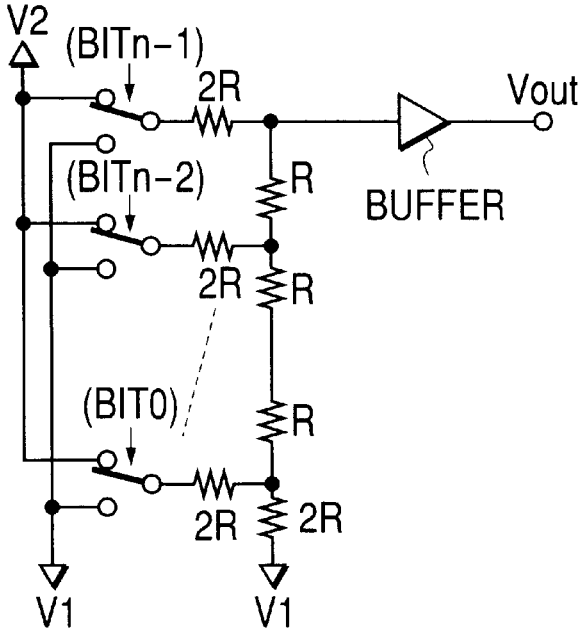
FIG. 5 is a circuit diagram showing an example of a D/A converter used in an embodiment of the present invention.
Figure 6:
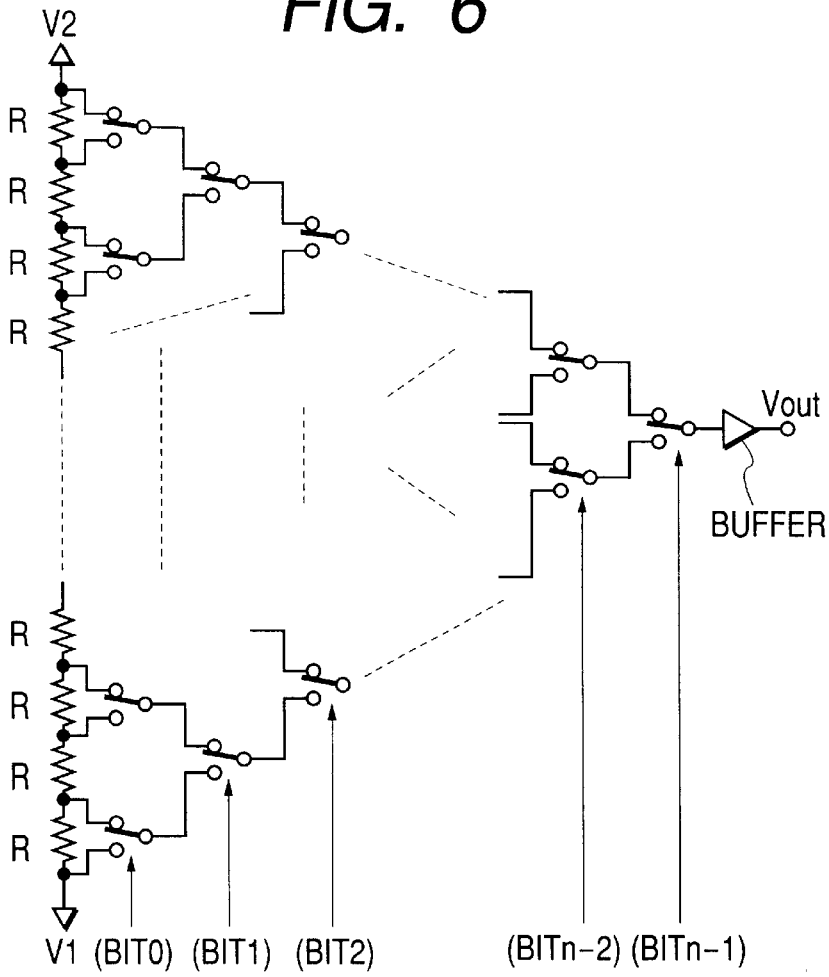
FIG. 6 is a circuit diagram showing another example of the D/A converter used in the embodiment of the present invention.

As the structure of the D/A converter, any type of a D/A converter may be used as far as a desired characteristic can be obtained, including an R-2R D/A converter as shown in FIG. 5 and those of a type in which two reference voltages are divided, and the divided voltages are switched by a switch (the series resistance type) as shown in FIG. 6.

Figure 7:
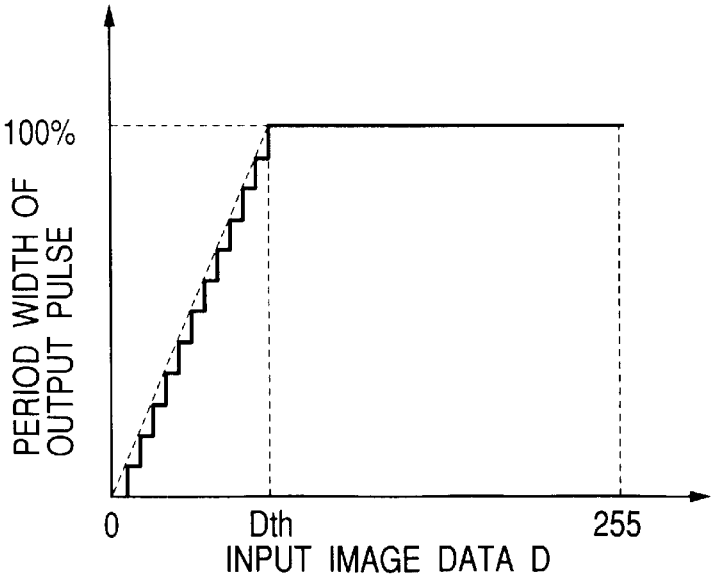
FIG. 7 is a graph showing a period width characteristic of modulation signals AM1 to AMn in accordance with the first embodiment.

The pulse width control unit 2002 is a circuit that generates a control signal for switching the switch 2001 in accordance with the inputted image signal. The pulse width control unit 2002 and the switch 2001 control a period of time (output pulse width) during which the output of the D/A converter is supplied in accordance with the magnitude of the input image data as shown in a graph of FIG. 7. That is, the output pulse width is set to 100% with respect to the image data of Dth or more whereas the output pulse width is limited as shown in FIG. 7 with respect to the image data of Dth or less. In this embodiment, the pulse width is limited by a straight line that passes through one point where the pulse width is 0 when the image data is 0, and another point where the pulse width is 100% when the image data is Dth.

Figure 8:
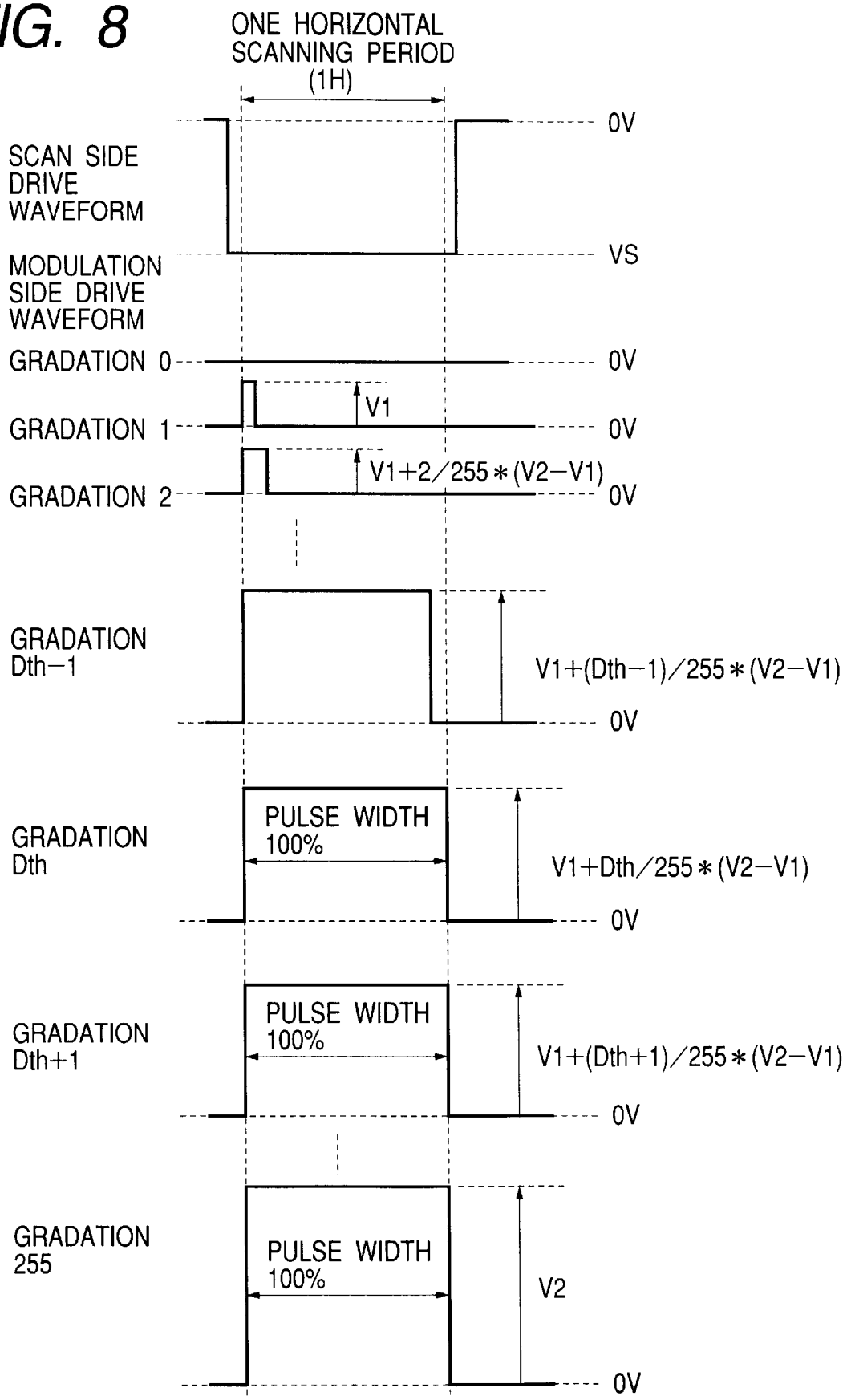
FIG. 8 is a graph showing a driving waveform example of the modulation signals AM1 to AMn in accordance with the first embodiment.

An example of the output waveform of the modulation unit is shown in FIG. 8.

As a result of preparing the above-mentioned modulation unit to drive the display panel, there can be reduced a phenomenon in which the luminance of a portion where the input image data is small (lower gradation portion) rises and which is a problem with the conventional device, and more particularly even in the case where the input image data is 0 (applied voltage V1), the light emission luminance can be set to 0.

As a result, this embodiment is very advantageous in that the contrast of the image can be improved, and the display grade can be improved.

Figure 9:
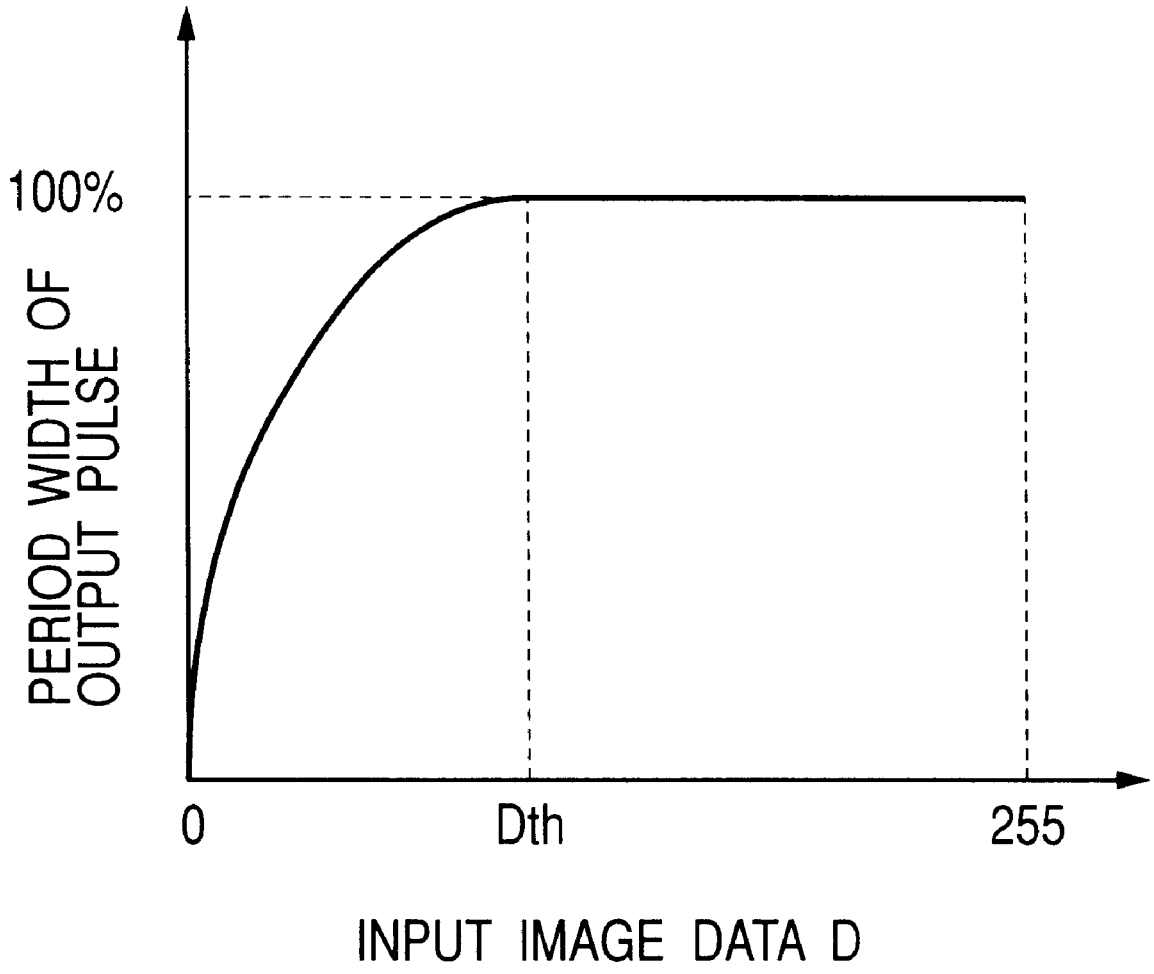
FIG. 9 is a graph showing a more preferable period width characteristic of the modulation signals AM1 to AMn in accordance with the first embodiment.

In this embodiment, the period width of the output pulse is controlled as shown in FIG. 7, but the present invention is not limited to this, for example, in order to improve the continuation of the pulse width in the period widthwise direction, the pulse width may be limited on the basis of the characteristic shown in FIG. 9.

Also, in this embodiment, the inputted image signal is driven by modulating both of the amplitude of the output pulse and the pulse width with respect to the image data of Dth or less, but the present invention is not particularly limited to this.

In other words, the present inventors have already confirmed that even in the case where the amplitude of the output signal is fixed to the amplitude at the time when the input image data is Dth to control the pulse width, the same effect is obtained.

Note that, as the structure of the D/A converter 2000, any type of a D/A converter may be used as far as a desired characteristic can be obtained, including an R-2R D/A converter as shown in FIG. 5 and those of a type in which two reference voltages are divided, and the divided voltages are switched by a switch as shown in FIG. 6.

On the other hand, when the present inventors constructed the modulation unit of this embodiment by using the R-2R type D/A converter shown in FIG. 5, the D/A converter can be constructed with a greatly reduced number of parts such as switches and resistors of the D/A converter, thereby realizing a great advantage in terms of the costs.

Also, when the present inventors constructed the modulation unit of this embodiment by using the D/A converter of the series resistance type shown in FIG. 6, although the number of parts such as switches and resistors increased, it had such features that the conversion error is reduced and the linearity is excellent as compared with a case where a D/A converter of another system is used, so that when used in the image display device, it can advantageously enhance the display quality thereof.

In this embodiment, the light emission luminance is measured while adjusting the amplitude of the output pulse and the period width of the output pulse with respect to the region of Dth or less, to determine the output pulse width so as to emit a light of the luminance corresponding to the inverse $\gamma$ characteristic of the 2.2nd power, thereby leading to an excellent effect such that the display grade of the display image can be further enhanced.

Second Embodiment

A second embodiment of the present invention provides an example in which in an image display device having a large number of surface conduction electron emitting devices, the modulation unit is so structured as to generate not a linear output but a non-linear output with respect to the input image data, to thereby display an image excellent in gradation and high in contrast.

Figure 12:
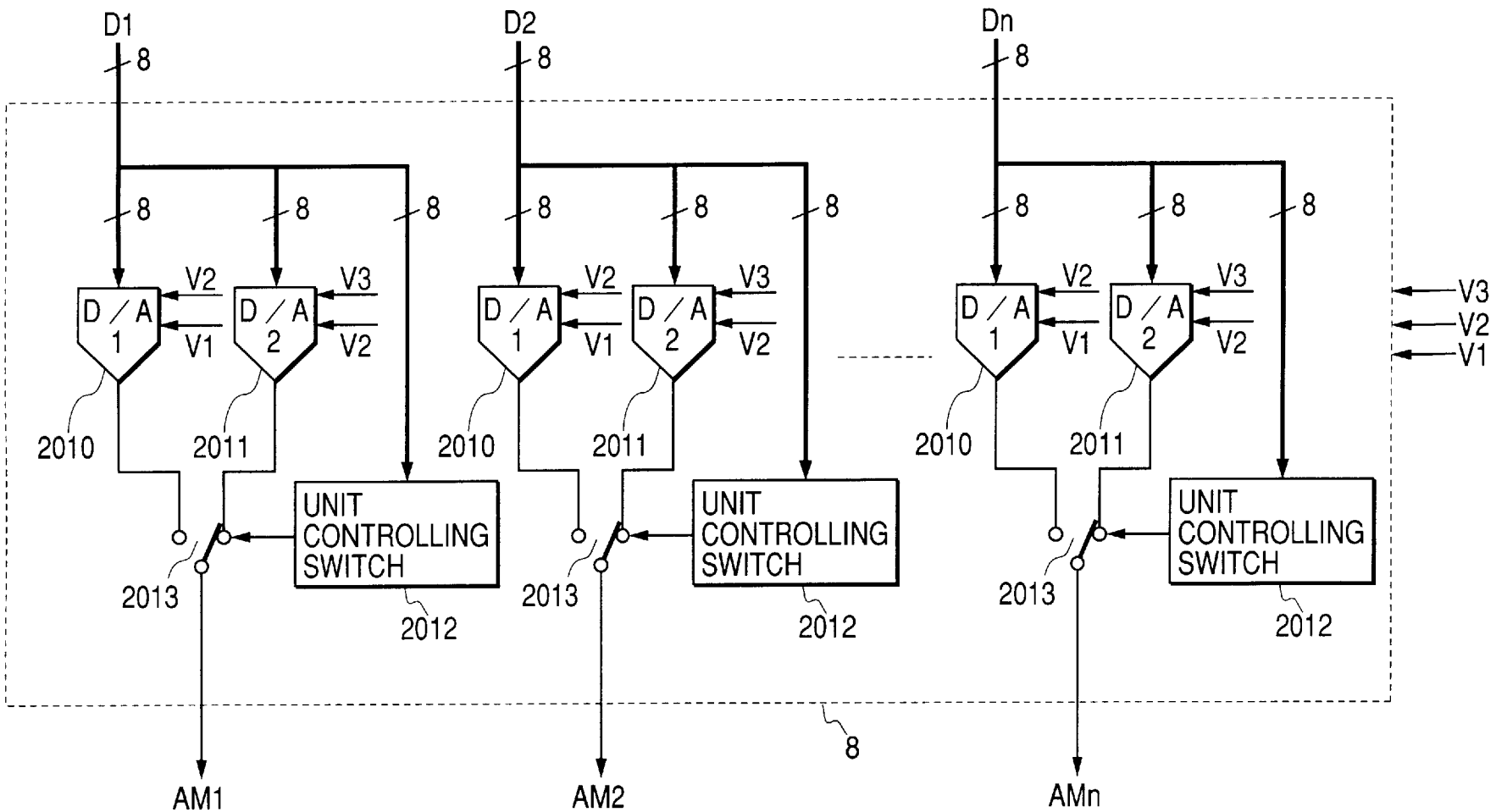
FIG. 12 is a block diagram showing a modulation unit in accordance with a second embodiment of the present invention.

The rough structure of the display device according to this embodiment can be represented by a block diagram shown in FIG. 1. In this embodiment, in order to subject the image data inputted to the modulation unit 8 to amplitude modulation due to non-linear voltage amplitude, the modulation unit 8 is structured as shown in FIG. 12. Similarly, in this embodiment, the input image data to the modulation unit 8 is set to 8 bits.

Modulation Unit According to this Embodiment

A block diagram of the modulation unit 8 according to this embodiment is shown in FIG. 12. In the figure, reference numeral 2010 denotes a first D/A converter, 2011 is a second D/A converter, 2012 is a switch controlling unit, and 2013 is a switch for switching the output of the D/A converter 2010 and the output of the D/A converter 2011.

The modulation unit 8 according to this embodiment is applied with three reference voltages consisting of reference voltages V1, V2 and V3 from the reference voltage setting unit 9 shown in FIG. 1.

The first D/A converter 2010 is supplied with V1 and V2 among those three reference voltages, and the second D/A converter 2011 is supplied with V2 and V3.

As the structure of the D/A converter 2010 and 2011, any type of a D/A converter may be used as far as a desired characteristic can be obtained, including an R-2R D/A converter as shown in FIG. 5 and those of a type in which two reference voltages are divided, and the divided voltages are switched by a switch (the series resistance type) as shown in FIG. 6.

The switch 2013 and the switch controlling unit supply the voltage output of the first D/A converter 2010 to the column wirings of the panel if the input image data is lower than Dth, whereas they supply the voltage output of the second D/A converter 2011 to the column wirings of the panel if the input image data is Dth or higher.

Figure 13:
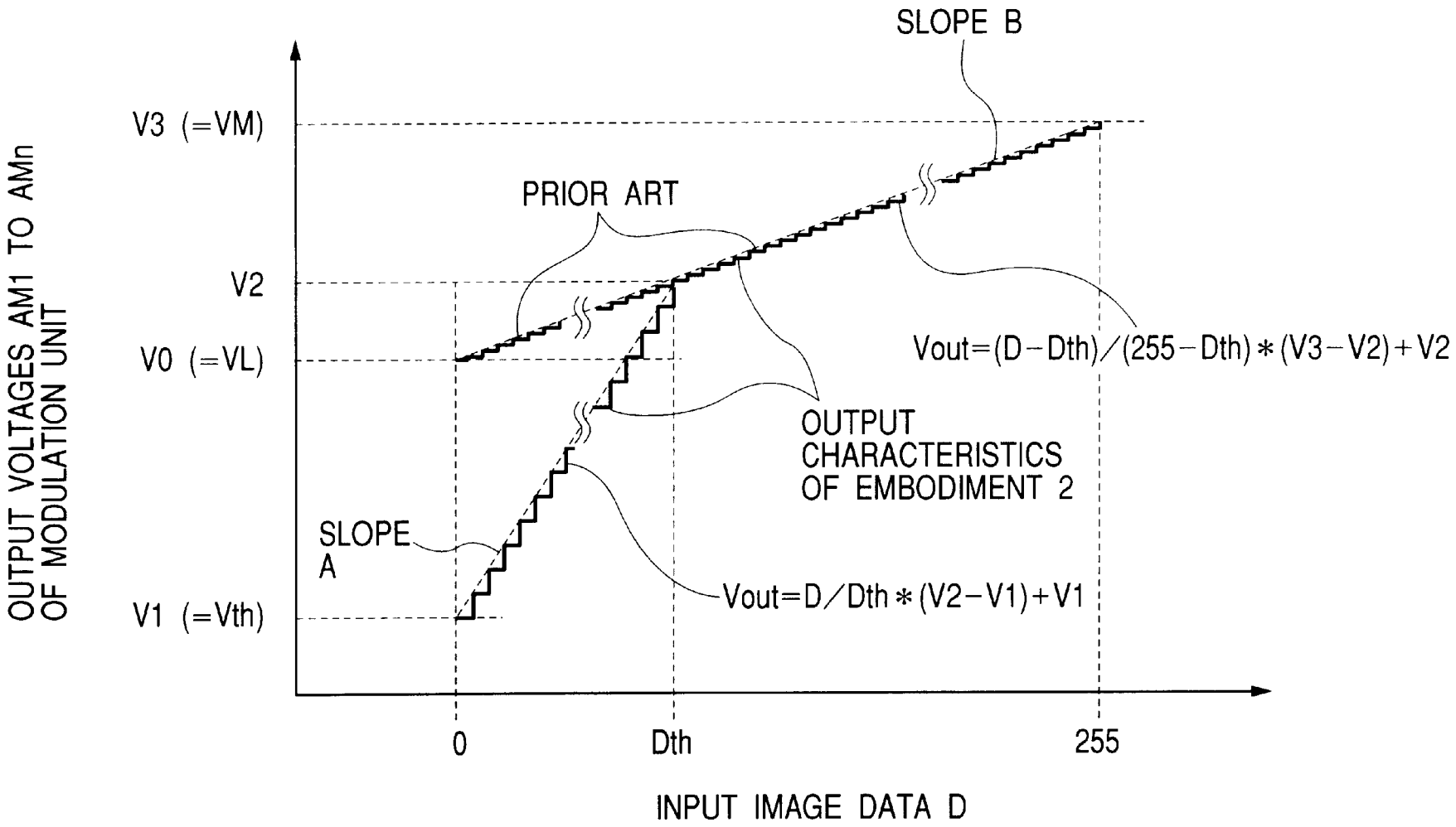
FIG. 13 is a graph showing an input/output characteristic of the modulation unit shown in FIG. 12.

Accordingly, the column wirings are supplied with the driving voltage of the amplitude shown in FIG. 13 with respect to the input image data. In this situation, as shown in FIG. 13, a slope A between O and Dth and an slope B between Dth and 255 have a relationship of "slope A>slope B". In this embodiment, because the polarity of the output voltage of the modulation unit is set to be positive and the selection voltage of the scan unit is set to be negative, the slope A>slope B is satisfied. However, in the case where the polarity of the voltage is reverse, the slope A<slope B is satisfied. That is, in this embodiment, as a result that the output characteristic of the modulation unit is provided with the stepped input/output characteristic in which the absolute value thereof gradually becomes smaller as the gradation of the input image data increases more, a very preferable result is obtained.

Up to now, as shown in FIG. 13, because the output of the modulation unit on a straight line that passes through two points of (0, VL) and (255, VM) is modulated, the luminance in a region where the gradation of the input image data is low is caused to increase more than that as required, to thereby lessen the contrast of the image and to deteriorate the display grade of black.

On the other hand, in the case where the modulation unit according to this embodiment is used, modulation is conducted in the region where the input image data is Dth or less in accordance with the voltage output of the first DA converter, thereby being capable of relatively lowering the voltage which is applied to the cold cathode device as compared with the conventional one if the input image data is Dth or less as shown in FIG. 13.

Also, in the case where the voltage of V1 is set to be the threshold voltage Vth or less at which the emission current Ie starts to be emitted, if the input image data is 0, the emission current Ie can be set to 0. In this embodiment, V1 is set to Vth.

As a result of manufacturing the image display device including the modulation unit thus structured therein to display the image, there can be reduced a phenomenon in which the luminance of a portion where the input image data is small (lower gradation portion) rises and which is a problem with the conventional device, and more particularly even in the case where the input image data is 0 (applied voltage V1), the light emission luminance can be set to 0.

As a result, this embodiment is very advantageous in that, for example, the contrast of the image can be improved, and the display grade can be improved.

In this embodiment, the characteristic shown in FIG. 13 is realized as the amplitude characteristic of the modulation unit with respect to the input image data by those two D/A converters shown in FIG. 12, but the present invention is not particularly limited to this.

Figure 14:
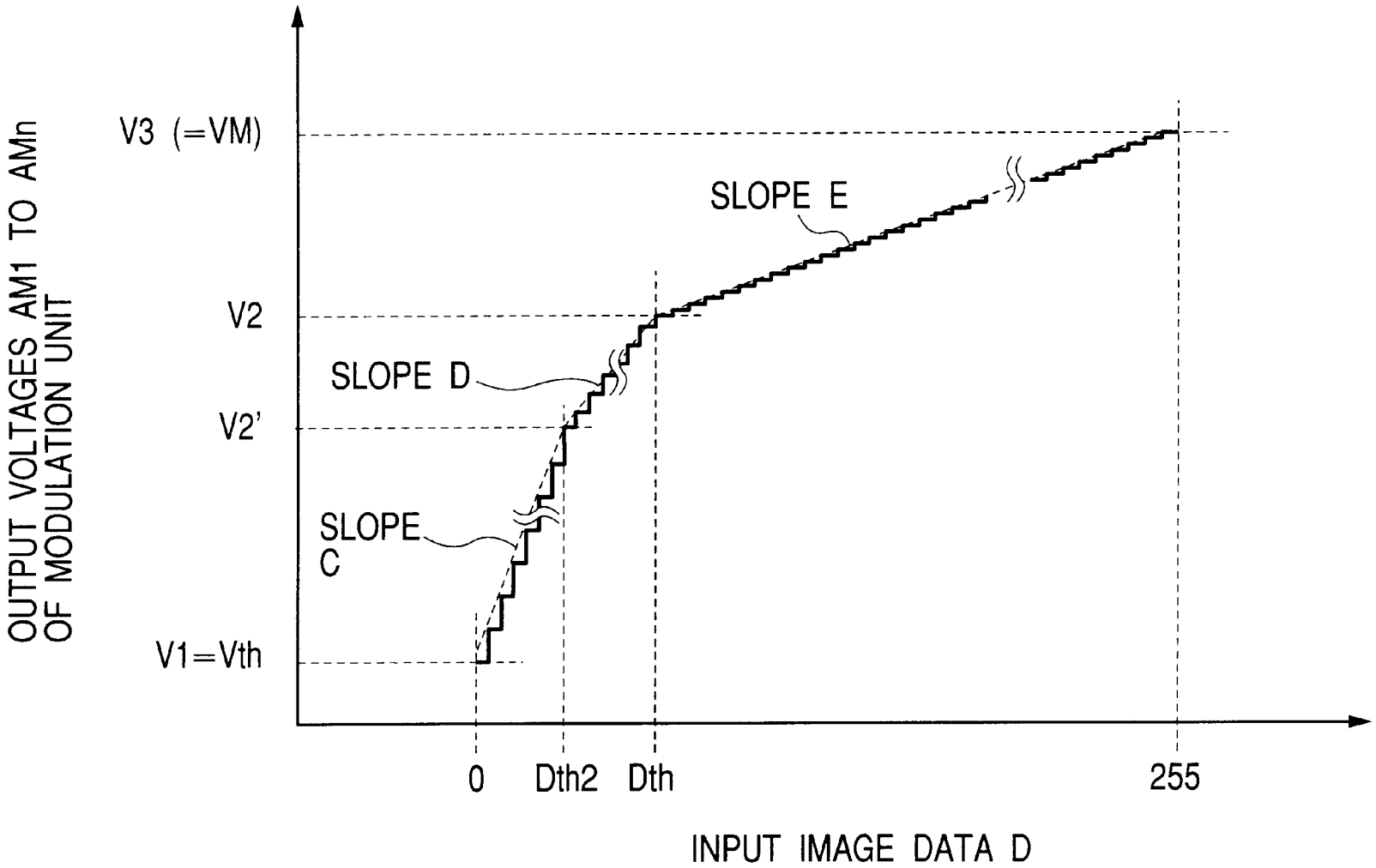
FIG. 14 is a diagram showing the input/output characteristic example in a modified example of the modifying means shown in FIG. 12.

In this embodiment, the pitches of the amplitude characteristic of the modulation unit is changed with Dth as a threshold value to improve the contrast of the image display device. More preferably, in order to reduce unpleasant sensation due to a change in the pitch, for example, as shown in FIG. 14, if an additional threshold value Dth2 is provided so that the switching of the pitches is made multistep, the image display smooth in gradation characteristic and high in grade is enabled. The above facts have been proved by the present inventors.

In order to realize this, for example, the two D/A converters shown in FIG. 12 are increased to three D/A converters, and reference voltages such as reference voltages V1, V2', V2 and V3 are applied to those three D/A converters. In this situation, as shown in FIG. 14, an slope C between 0 and Dth2, an slope D between Dth2 to Dth and an slope E between Dth and 255 have a relationship of "slope C>slope D>slope E". In this embodiment, because the polarity of the output voltage of the modulation unit is set to be positive and the polarity of the selection voltage of the scan unit is set to be negative, the relationship of slope C>slope D>slope E is satisfied. However, in the case where the polarity of the voltage is reverse, the relationship of slope C<slope D<slope E is satisfied. That is, in the present invention, since the input/output characteristic of the modulation unit is set such that the absolute value of the output becomes stepped in which the absolute value of slope gradually becomes smaller as the input image data increases more, a very preferable result is obtained.

In addition, similarly, in the case where the number of D/A converters and the number of reference voltages to be applied are increased, as a result of providing the stepped input/output characteristic in which the absolute value of the slope of the output characteristic of the modulation unit gradually reduces as the input image data increases more, the result is very preferable.

In the above-mentioned embodiment, the pitches of the amplitude characteristic of the modulation unit are switched in triple stages, but it is needless to say that because the gradation characteristic improves more as the number of stages increases more, the grade of the display image can be more improved.

Also, the D/A converter according to this embodiment may be structured as follows:

That is, the D/A converters 2010 and 2011 shown in FIG. 12 may generate a correct output only when the input image data falls within a certain range, so that it is not always necessary that the same number of bits as that of the input image data is provided.

For example, in the case where the D/A converters 2010 and 2011 are manufactured through the system shown in FIG. 6, if the D/A converter 2010 has the same number of circuits as the number of gradations of 0 to Dth−1 steps, and also the D/A converter 2011 has the same number of circuits as the number of gradations of (255−Dth) steps of from Dth to 255, there are many advantages such that the circuit can be downsized.

Also, as another example, if the resistances of plural resistors R are set to different resistances, respectively, which are identical in resistance with each other in FIG. 6, even if a plurality of D/A converters are not used, the output characteristic of the above-mentioned modulation unit can be realized by one D/A converter.

The present inventors have confirmed that in the above-mentioned system, if the resistors R are manufactured with high precision, not only the number of steps at which the pitches are switched can be made plural, but also ultimately, the resistance for each of the resistances R is smoothly changed, thereby being capable of manufacturing the image display device that is high in contrast and very smooth in the gradation characteristic.

Further, in this situation, the output characteristic of the modulation unit also has the stepped input/output characteristic in which the absolute value of the slope gradually decreases more as the input image data increases more, and the display quality becomes very preferable.

As the structure of the D/A converter 2010 and 2011, any type of a D/A converter may be used as far as a desired characteristic can be obtained, including an R-2R D/A converter as shown in FIG. 5 and those of a type in which two reference voltages are divided, and the divided voltages are switched by a switch as shown in FIG. 6.

On the other hand, when the present inventors constructed the modulation unit of this embodiment by using the R-2R type D/A converter shown in FIG. 5, it was possible to construct the D/A converter with a greatly reduced number of parts such as switches and resistors of the D/A converter, thereby realizing a great advantage in terms of the costs.

Also, when the present inventors constructed the modulation unit of this embodiment by using the D/A converter of the series resistances shown in FIG. 6, although the number of parts such as switches and resistors increases, it had such features that the conversion error is reduced and the linearity is excellent as compared with a case of using a D/A converter of another system, and therefore it has an advantage such that the image quality of an image display device can be improved when it is used in the image display device.

Third Embodiment

Figure 15:
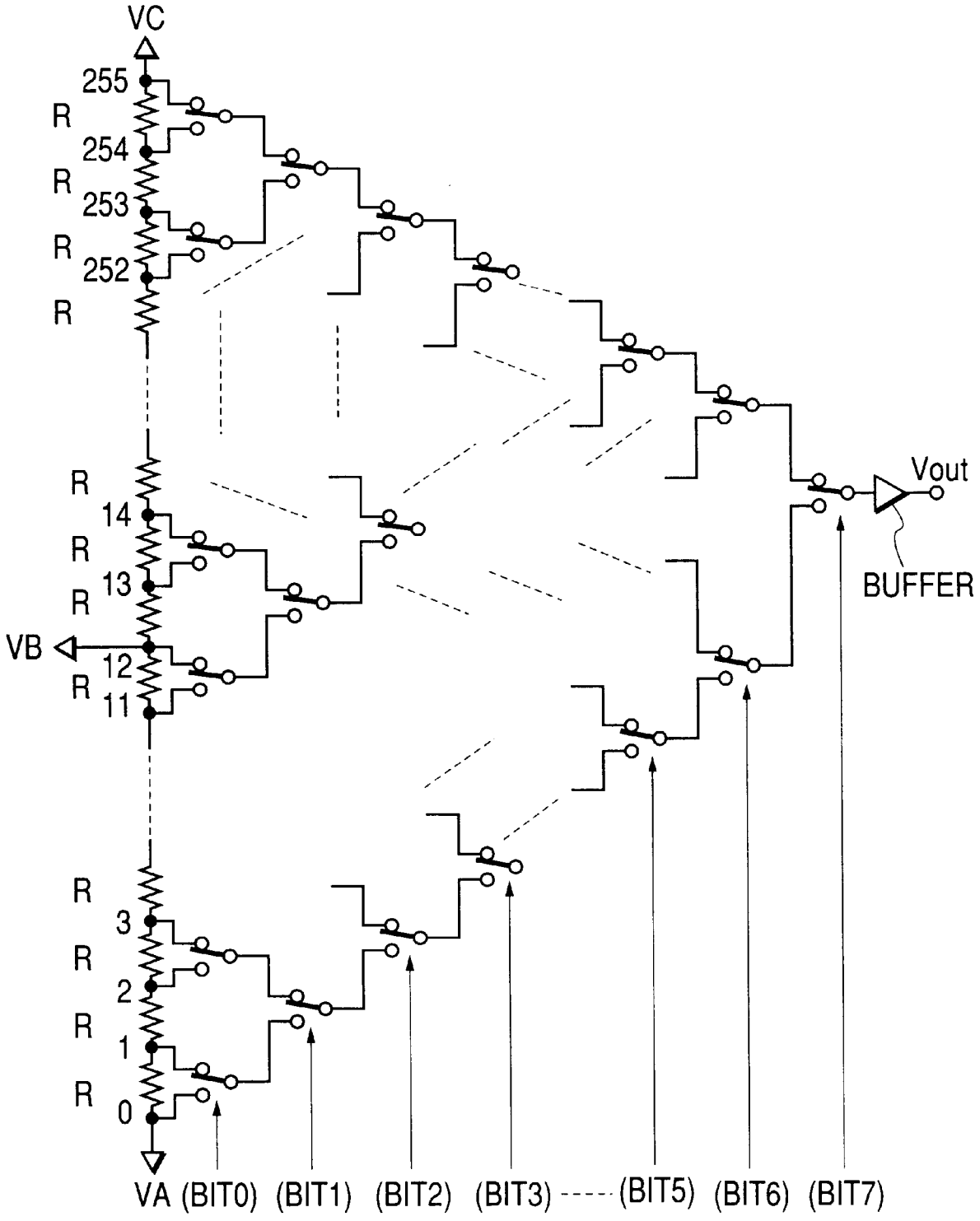
FIG. 15 is a circuit diagram showing a D/A converter used in a modulation unit in accordance with a third embodiment of the present invention.

In addition, even if the following modulation unit is employed, the same characteristic as that in the second embodiment can be realized. FIG. 15 shows an example of the structure of the modulation unit with respect to one line wiring in the case where an slope of the output characteristic of the modulation unit is changed between a case where the input image data is 0 to 12 gradations and a case where the input image data is 12 to 255 gradations assuming that Dth is 12.

In this embodiment, a series resistor type D/A converter shown in FIG. 15 is used. As the reference voltage, as shown in the figure, VA and VC are supplied to both ends of the series resistors, and a voltage VB is applied to a node of a position corresponding to the twelfth gradation.

Even in this circuit, if the reference voltages VA, VB and VC are selected so as to become desired voltages, the output characteristic of the modulation unit shown in FIG. 13 can be obtained.

The structure of this embodiment consists of one D/A converter, and the present invention can be applied to this example. Also, needless to say, the aspect is changed in this embodiment similarly, assuming that the series resistor portion including the gradations of 0 to 12 and the switch are first D/A converter, the series resistor portion including the gradations of 12 to 255 and the switch are the second D/A converter, the modulation unit consists of a plurality of D/A converters.

Also, if another reference voltage is applied between positions corresponding to the gradations 12 and 0, the output voltage characteristic of the modulation unit can be stepped with more multistage slopes. As a result, the smooth input/output characteristic can be provided without rapidly changing the slope, which is very advantageous in that the smooth gradation characteristic and the high contrast which is an object of the present invention can be realized at the same time.

As a result that the image display devices including the above-mentioned various modulation units therein are prepared to display the image, there can be reduced a phenomenon in which the luminance of a portion where the input image data is small (lower gradation portion) rises and which is a problem with the conventional device, and more particularly even in the case where the input image data is 0 (applied voltage V1), the light emission luminance can be set to 0.

As a result, this embodiment is very advantageous in that the contrast of the image can be improved, and the display grade can be improved.

Fourth Embodiment

A fourth embodiment of the present invention is an example in which in a display device having a large number of surface conduction electron emitting devices, in order to display an image excellent in the gradation and high in the contrast, the modulation unit of the image display device is so structured as to generate not a linear output but a non-linear output with respect to the input image data, to thereby solve the problem with the conventional device.

Figure 16:
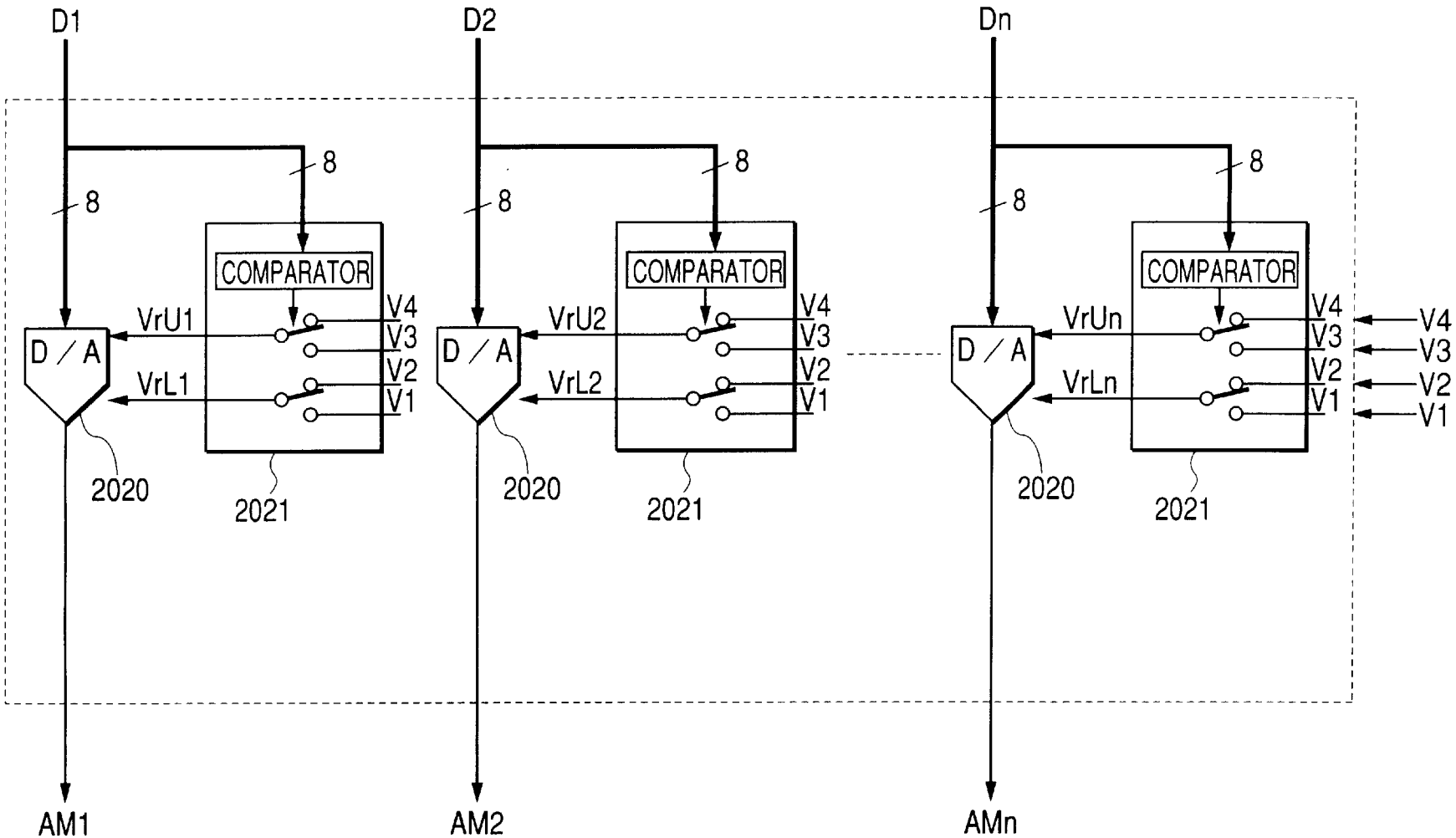
FIG. 16 is a block diagram showing a modulation unit in accordance with a fourth embodiment of the present invention.

The rough block diagram of the display device can be represented by a block diagram shown in FIG. 1. In this embodiment, in order to subject the image data inputted to the modulation unit to amplitude modulation due to the non-linear voltage amplitude, a modulation unit shown in FIG. 16 is disposed as the modulation unit. Similarly, in this embodiment, the input image data to the modulation unit is set to 8 bits.

Modulation Unit According to this Embodiment

A block diagram of the modulation unit 8 according to this embodiment is shown in FIG. 16. In the figure, reference numeral 2020 denotes D/A converters, 2021 is reference voltage selecting portions each of which is formed for each of the column wirings.

The modulation unit 8 according to this embodiment is supplied with four reference voltages consisting of reference voltages V1, V2, V3 and V4 from the reference voltage setting unit 9 shown in FIG. 1.

The D/A Converter According to this Embodiment

As the example of the D/A converter, any type of a D/A converter may be used as far as a desired characteristic can be obtained, including an R-2R D/A converter as shown in FIG. 5 and those of a type in which two reference voltages are divided, and the divided voltages are switched by a switch (the series resistance type) as shown in FIG. 6.

In this embodiment, a voltage (a reference voltage at an upper side of the D/A converter) corresponding to the reference voltage V2 in FIGS. 5 and 6 is defined as VrUi (i is column number, and i=1, 2, . . . n), and a voltage (a reference voltage at a lower side of the D/A converter) corresponding to the reference voltage V1 is defined as VrLi (i is column number, and i=1, 2, . . . n).

Reference Voltage Selecting Portion

The reference voltage selecting portion 2021 is a circuit that switches the reference voltages V1 to V4 supplied from the reference voltage setting unit 9 (refer to FIG. 1) on the basis of the input image data Di (i=1, 2, . . . n).

More specifically, the circuit conducts switching in the following manner.

In the case where the input image data Di (i=1, 2, . . . n) is Dth or more (Di≦Dth), VrUi=V4 (i=1, 2, . . . n)

VrLi=V2 (i=1, 2, . . . n)

In the case where the input image data Di (i=1, 2, . . . n) is less than Dth (Di<Dth), VrUi=V3 (i=1, 2, . . . n)

VrLi=V1 (i=1, 2, . . . n)

The reference voltage selecting portion 2021 can be simply structured by a comparator, a switch and the like.

Figure 17:
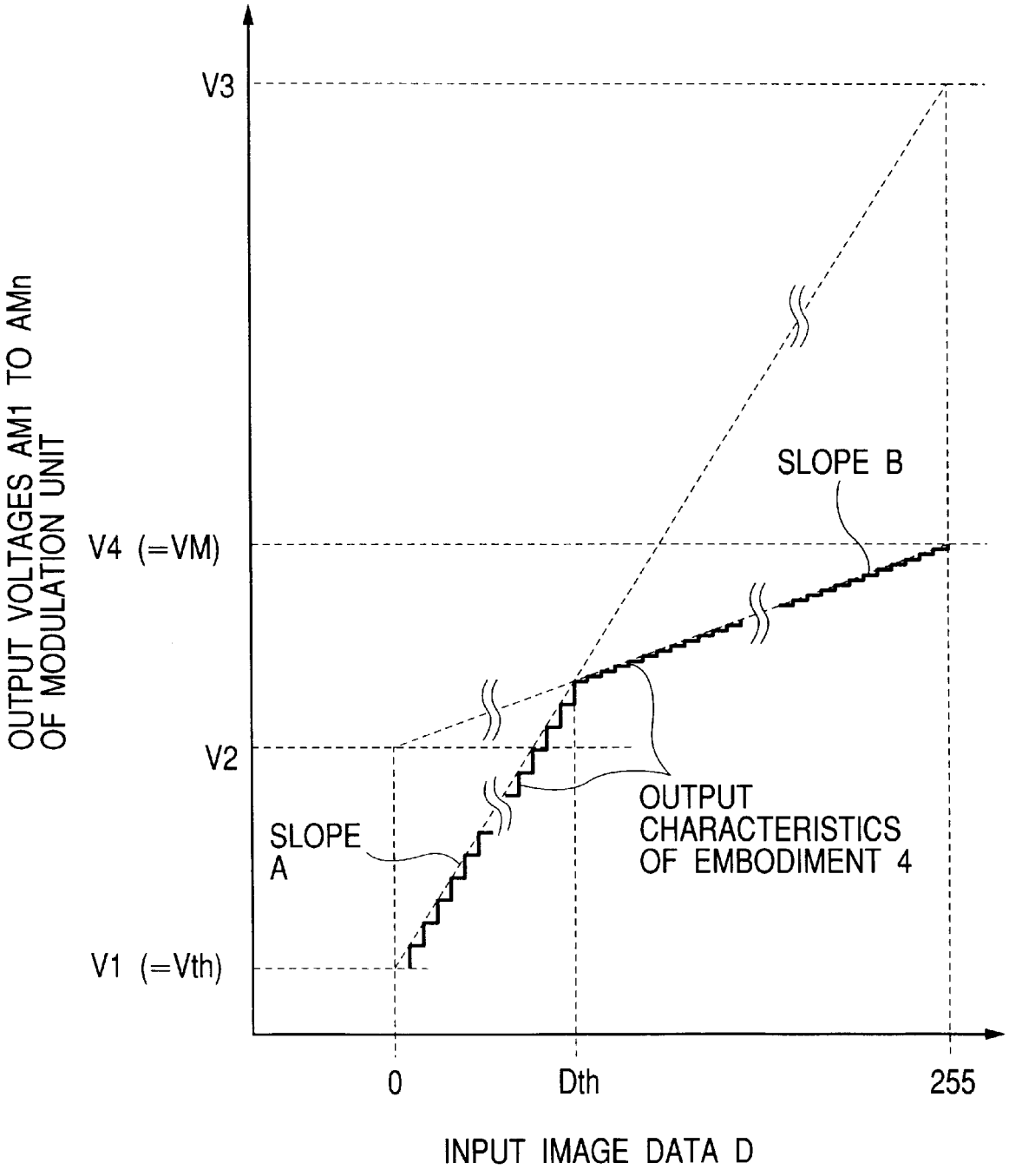
FIG. 17 is a graph showing an input/output characteristic of the modulation unit shown in FIG. 16.

As a result of switching the reference voltage that is applied to the D/A converter with respect to the input image data as described above, the output characteristic shown in FIG. 17 can be obtained as the output voltage of the modulation unit.

With setting the reference voltage to a desired voltage, the modulation unit having the same output characteristic as that described in the second and third embodiments can be structured.

As a result, there are very advantageous in that the contrast of the image can be improved, and the display grade can be improved.

In this embodiment, the reference voltages are switched with Dth as a threshold value, and also the present inventors have confirmed that if another threshold value is provided with respect to the input image data so that the reference voltages that are applied to the D/A converter are switched in a multistage manner, the gradation characteristic can be more smoothed, and the image display with high grade can be conducted.

In order to realize this, for example, if the kind of reference voltages to be applied from the reference voltage setting unit 9 shown in FIG. 1 is increased, and the number of comparators and the number of switches in the reference voltage selecting unit are increased, the device can be simply manufactured.

As the structure of the D/A converter 2020, any type including an R-2R D/A converter shown in FIG. 5 and a type in which two reference voltages are divided, and the divided voltages are switched by a switch as shown in FIG. 6 is acceptable as long as a desired characteristic is obtained as described above.

On the other hand, as a result that the present inventors have realized the modulation unit of this embodiment by using the R-2R type D/A converter shown in FIG. 5, the D/A converter can be realized with a very reduced number of parts such as switches and resistors of the D/A converter, thereby leading to a large advantage from the viewpoint of the costs.

Also, as a result that the present inventors have realized the modulation unit of this embodiment by using the D/A converter of the series resistances shown in FIG. 6, although the number of parts such as switches and resistors increases, there are obtained advantages in that the conversion error is reduced and the linearity is excellent as compared with those in the case of using the D/A converter of another system, and in the case of using the modulation unit as the image display device, there is an advantage in that the display grade can be improved.

As to the number of stages at which the reference voltages are switched, the more number of stages is preferable as the display image because the gradation characteristic of the display image becomes smooth with the increased number of stages, but because the circuit is complicated, the number of stages is preferably determined taking the costs, the display grade and the like into consideration.

Fifth Embodiment

A fifth embodiment is an example in which in a display device having a large number of surface conduction electron emitting devices, in order to display the image excellent in the gradation and high in the contrast, the modulation unit of the image display device is so structured as to generate not a linear output but a non-linear output with respect to the input image data, to thereby solve the problem with the conventional device.

The rough structure of the display device according to this embodiment can be represented by a block diagram shown in FIG. 1. In this embodiment, because the image data inputted to the modulation unit is subjected to the amplitude modulation by the non-linear voltage amplitude, the modulation unit shown in FIG. 18 is disposed as the modulation unit.

Figure 18:
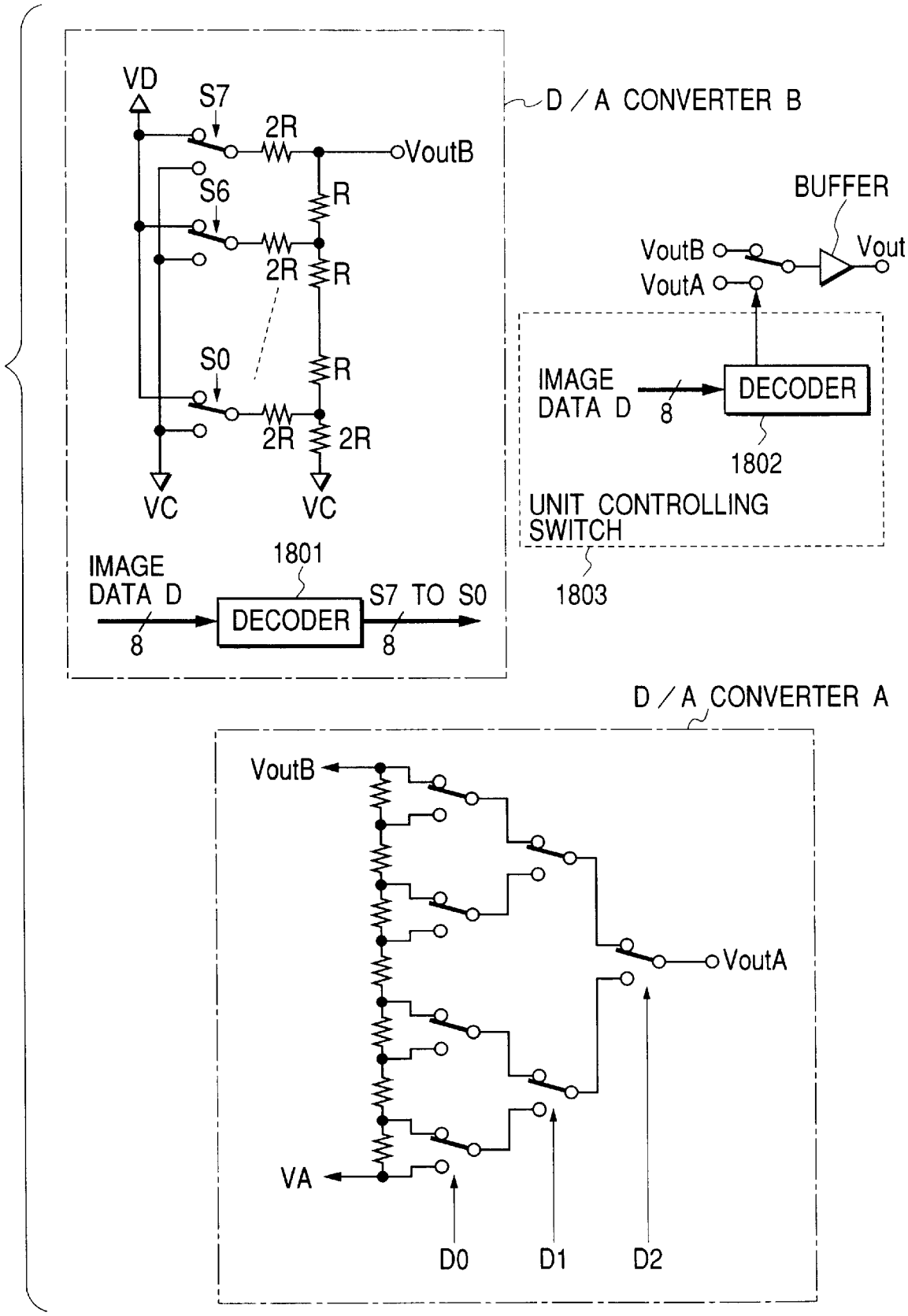
FIG. 18 is a block diagram showing a modulation unit in accordance with a fifth embodiment of the present invention.
Figure 19:
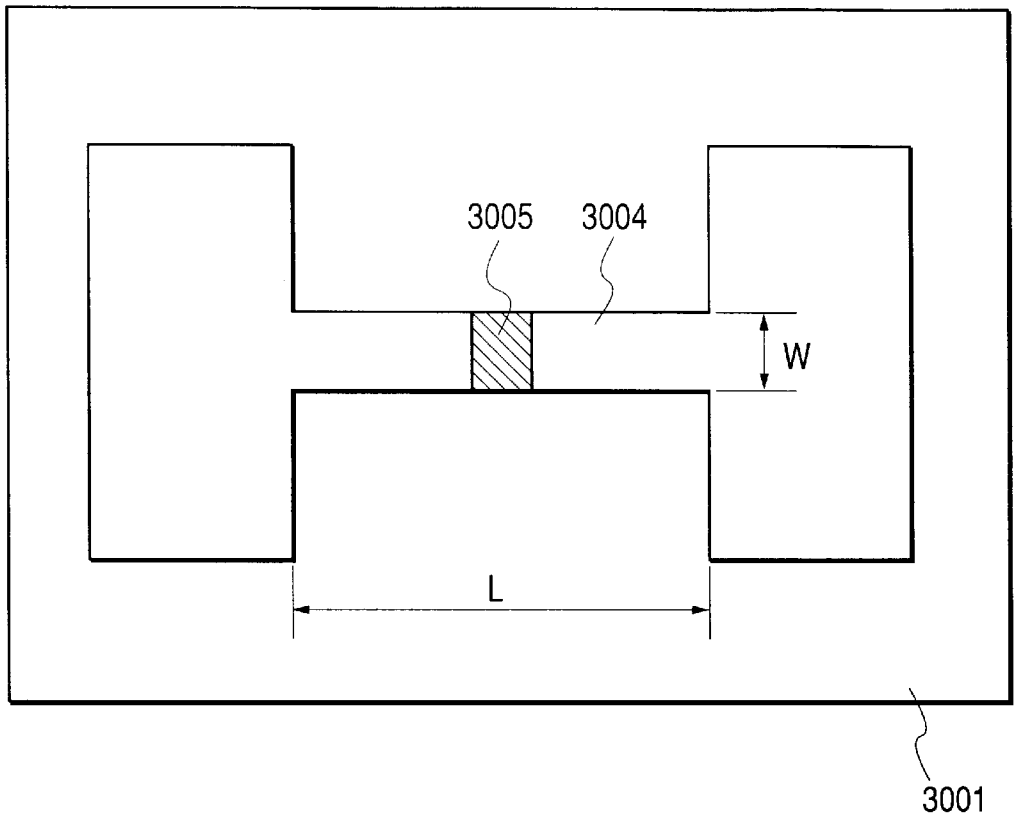
FIG. 19 is a diagram showing an example of a conventional surface conduction electron emitting device.
Figure 20:
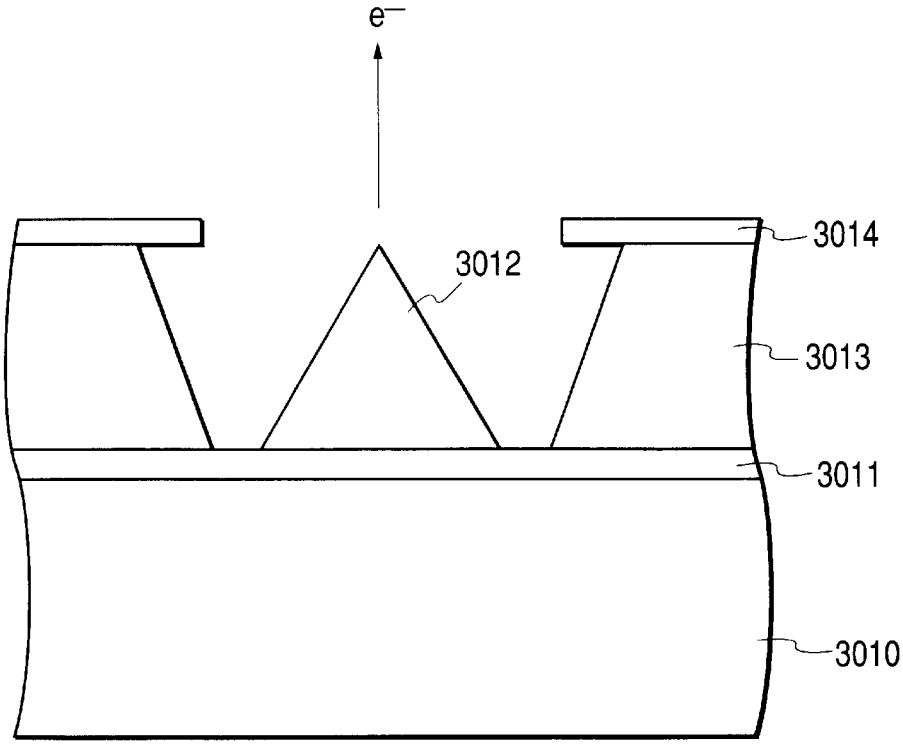
FIG. 20 is a diagram showing an example of a conventional FE electron emitting device.
Figure 21:
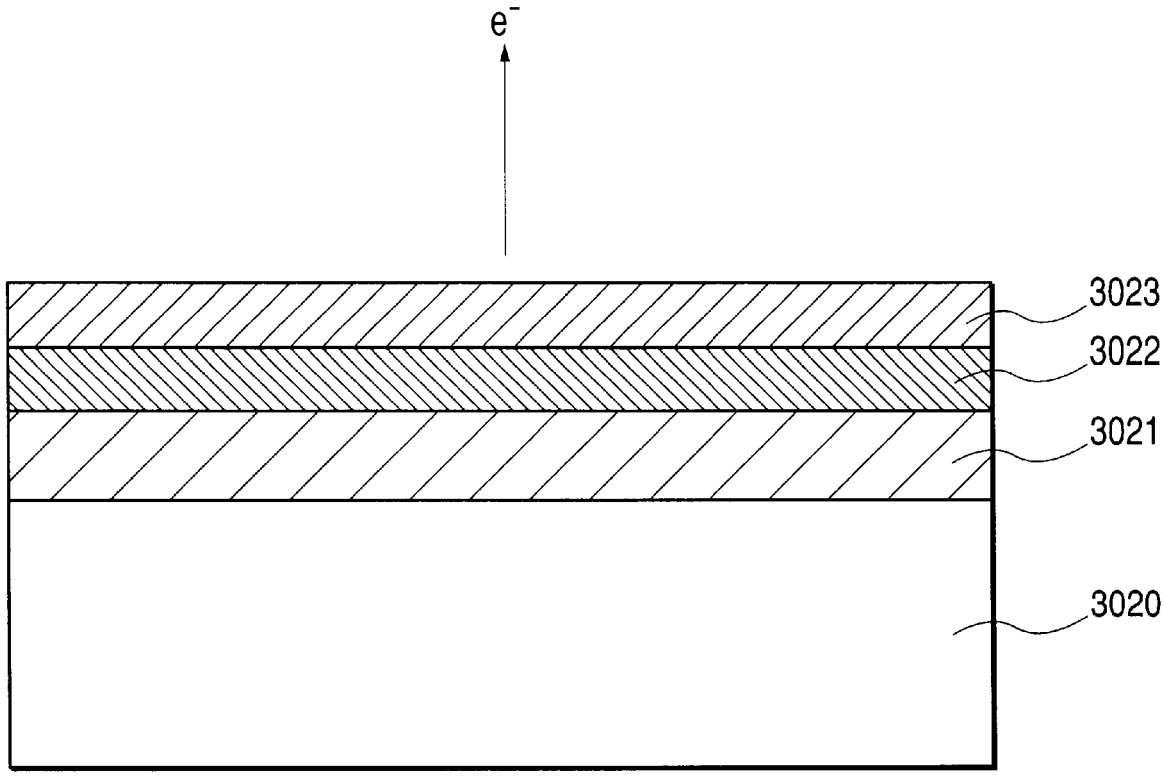
FIG. 21 is a diagram showing an example of a conventional MIM electron emitting device.
Figure 22:
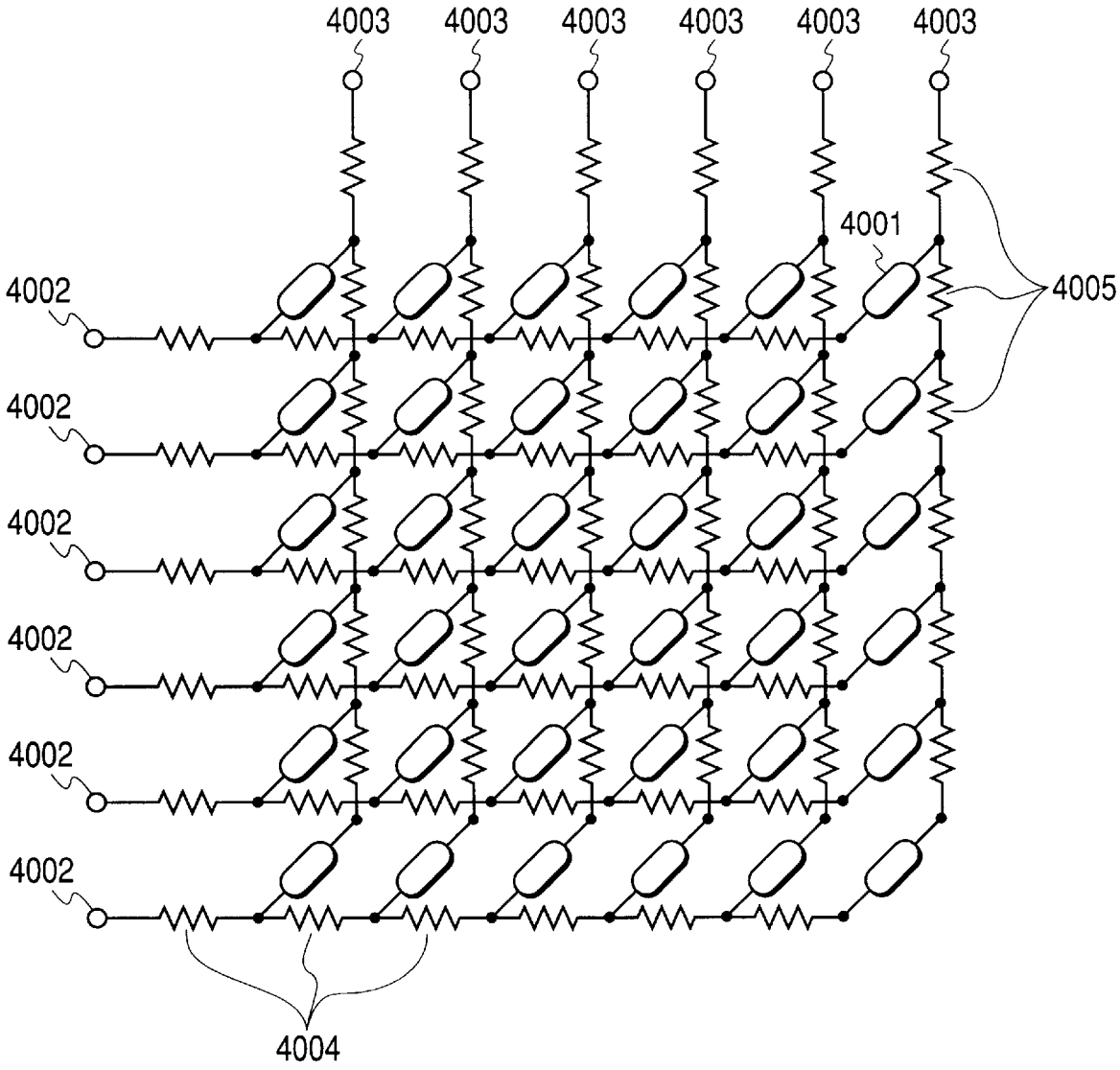
FIG. 22 is a diagram for explanation of the electric connection of a conventional multi electron source.

FIG. 18 shows the modulation unit corresponding to one line wiring, and as the entire modulation unit, the circuits shown in FIG. 18 are provided by the same number as that of the column wirings, that is, n number. Similarly, in this embodiment, the input image data to the modulation unit is set to 8 bits.

D/A Converter According to this Embodiment

As the D/A converter of the modulation unit according to this embodiment, as shown in FIG. 18, two D/A converters are employed. As shown in the figure, the D/A converter B is an R-2R type D/A converters, and the D/A converter A is a series resistor type D/A converter.

In this embodiment, the threshold value Dth of the input image data is 8, and if the input image data is 8 or more, the output of the D/A converter B is outputted to the column wirings, and if the input image data is less than 8, the output of the D/A converter A is outputted to the column wirings.

As the reference voltage of the D/A converter B, VD and VC are supplied from the reference voltage setting unit, and as the reference voltage to the D/A converter A, the outputs VoutB and VA of the D/A converter B are supplied from the reference voltage setting unit.

In this embodiment, the output characteristic of the modulation unit is prevented from being discontinuous by switching the D/A converters A and B due to setting VoutB as the reference voltage of the D/A converter B and the action of the first decoder 1801 which will be described later.

First Decoder Operation

The operation of the first decoder 1801 shown in FIG. 18 will be described. The first decoder is a circuit that generates control signals S7 to S0 for controlling the switch of the D/A converter B. The circuit makes the control signals S7 to S0 to the D/A converter B identical with the input image data if the input image data is 8 or more, and sets the control signal S7 to S0 to the D/A converter B to 8 if the input image data is less than 8.

Second Decoder Operation

The operation of a second decoder 1802 shown in FIG. 18 will be described. The second decoder conducts the switching in accordance with the input image data and generates the control signal that connects VoutB and VoutA to Vout.

The circuit generates the control signal so as to set the output VoutB of the D/A converter B to Vout if the input image data is 8 or more, and set the output VoutA of the D/A converter A to the output Vout, to thereby change over the switch.

Due to the action of the above-mentioned first and second decoders, if the input image data is less than 8, the output VoutB of the D/A converter B generates the output when the input image data is 8. VoutB is applied to the reference of the D/A converter A as described above, and in the D/A converter A, the output VoutA corresponding to lower significant 3 bits of the input image data is outputted, and Vout becomes equal to VoutA.

Also, if the input image data is 8 or more, the output VoutB of the D/A converter B becomes Vout.

As a result that the modulation unit is structured as described above, there is very advantageous in that the continuity at the position where the output characteristics of the D/A converters A and B are switched can be ensured (the continuation can be smoothed).

The input/output characteristic of the modulation unit can be made identical with the characteristic shown in FIG. 13 by setting the reference voltage to a desired value, and there are very excellent advantages in that the luminance of a lower gradation portion is reduced, the contrast of the image is improved, and the display grade can be improved.

Sixth Embodiment

It is preferable that the first to fifth embodiments further include the following embodiment.

In other words, in the modulation unit according to the first to fifth embodiments, the data is set to the D/A converter when one horizontal scan period starts or immediately before the one horizontal scan period, and the modulation voltages AM1 to AMn are outputted, but there is a fear that an unexpected voltage is outputted while the data is settled in the D/A converter.

In order to prevent this, it is preferable that the switches and the control units for short-circuiting the output of the modulation unit to the voltage at which the electrons are not emitted during the settling are disposed for each of the column wirings. The voltage at which the electrons are not emitted is a voltage in which a potential difference between the voltage that is applied to the selected row and the output voltage of the modulation unit is Vth or less.

It is needless to say that all the voltages of the row wirings are set to non-selection potential Vns during the settling.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

According to the image display device of the present invention, there were obtained such excellent effects that, compared to the conventional image display devices that not only a high contrast can be realized but also an excellent gradation characteristic without erasing the gradation can be realized.

What is claimed is:

1. An image display device comprising:

a display panel in which (m×n) cold cathode devices are connected in matrix by m row wirings and n column wirings;

scan means connected to said row wirings;

modulation means connected to said column wirings and inputting M-bit image data; and light emitting means disposed at positions opposite to said cold cathode devices;

wherein said modulation means includes M-bit voltage amplitude modulation means and pulse width limiting means, and a modulation signal that is supplied to said cold cathode devices is a voltage signal having an amplitude and a pulse width corresponding to the image data.

2. The image display device according to claim 1, wherein said modulation means operates based on a predetermined image data as a threshold value, to modulate only the amplitude of the modulation signal for the image data equal to or higher than the threshold value, and to limit by said pulse width limiting means the pulse width of the modulation signal for the image data lower than the threshold value.

3. The image display device according to claim 2, wherein said modulation means modulates further the amplitude of the modulation signal for the image data lower than the threshold value.

4. The image display device according to claim 1, wherein each of said cold cathode devices comprises a surface conduction electron emitting device.

5. The image display device according to claim 1, wherein each of said cold cathode devices is a field emission device.

6. The image display device according to claim 1, wherein each of said cold cathode devices comprises a MIM (metal/insulator/metal) device.

7. The image display device according to claim 1, wherein said image data is subjected to γ conversion.

8. An image display device comprising:

a display panel in which (m×n) cold cathode devices are connected in matrix by m row wirings and n column wirings;

scan means connected to said row wirings;

modulation means connected to said column wirings; and light emitting means disposed at positions opposite to said cold cathode devices;

wherein said modulation means is voltage amplitude modulation means having a non-linear input/output characteristic responsive to input image data, and wherein the absolute value of the output voltage of said voltage amplitude modulation means has a monotone increase characteristic responsive to the image data which is an input of the modulation means, and its increasing slope is gradually made gentle.

9. An image display device comprising:

a display panel in which (m×n) cold cathode devices are connected in matrix by m row wirings and n column wirings;

scan means connected to said row wirings;

modulation means connected to said column wirings; and light emitting means disposed at positions opposite to said cold cathode devices;

wherein said modulation means is voltage amplitude modulation means having a non-linear input/output characteristic responsive to input image data, and wherein said modulation means includes a D/A converter, and the output characteristic of said D/A converter has a monotone increasing characteristic for the image data that is an input, and its increasing slope is gradually made gentle.

10. An image display device comprising:

a display panel in which (m×n) cold cathode devices are connected in matrix by m row wirings and n column wirings;

scan means connected to said row wirings;

modulation means connected to said column wirings; and light emitting means disposed at positions opposite to said cold cathode devices;

wherein said modulation means is voltage amplitude modulation means having a non-linear input/output characteristic responsive to input image data, and wherein the absolute value of the output voltage of said voltage amplitude modulation means has K threshold values $D_1$ to $D_K$ (where $D_1<D_2<\ldots<D_K$, and K is an integer of 1 or more) for the image data that is an input of said modulation means, and has a stepped characteristic having:

a first slope at $0 \leqq \text{Data} < D_1$;

a second slope at $D_1 \leqq \text{Data} < D_2$;

a K-th slope at $D_{K-1} \leqq \text{Data} < D_K$; and a (K+1)-th slope at $D_K \leqq \text{Data}$.

11. The image display device according to claim 10, wherein the slopes of said first to (K+1)-th ($K \geqq 1$) satisfy the relationship that the first slope> the second slope> . . . >the (K+1)-th slope.

12. The image display device according to claim 10, wherein said voltage amplitude modulation means comprises a D/A converter having the stepped input/output characteristic.

13. The image display device according to claim 10, wherein said voltage amplitude modulation means includes a D/A converter and switches the reference voltage of the D/A converter with Di (I=1, 2, . . . K) as a threshold value.

14. The image display device according to claim 10, wherein said voltage amplitude modulation means includes a plurality of D/A converters to which different reference voltages are applied, and switches the outputs of the D/A converters based on Di (i=1, 2, . . . K) as a threshold value.

15. The image display device according to any one of claims 12 to 14, wherein said voltage amplitude modulation means outputs a predetermined voltage during settling of said D/A converter.

16. The image display device according to any one of claims 12 to 14, wherein said scan means outputs a non-selection voltage during the settling of said D/A converter.

17. The image display device according to any one of claims 8, or 10 to 14, wherein said voltage amplitude modulation unit further comprises means for outputting a predetermined voltage independent of the input image data.

18. A method of driving an image display device comprising:

a display panel in which (m×n) cold cathode devices are connected in matrix by m row wirings and n column wirings;

scan means connected to said row wirings;

modulation means connected to said column wirings; and light emitting means disposed at positions opposite to said cold cathode devices;

said method comprising the steps of:

judging whether inputted image data is larger or smaller than a threshold value, which is based on a predetermined image data as the threshold value; and determining an amplitude and pulse width of an output from said modulation means in accordance with the image data and the result of said judgment;

wherein, in said determining step, a signal in which the pulse width is constant and only the amplitude is modulated is outputted when the image data is larger than the threshold value, and a signal in which the amplitude is constant and only the pulse width is modulated, or a signal in which both of the amplitude and the pulse width are modulated is outputted when the image data is smaller than the threshold value.

19. An image display device comprising:

a display panel in which (m×n) cold cathode devices are connected in matrix by m row wirings and n column wirings;

scan means connected to said row wirings;

modulation means connected to said column wirings; and light emitting means disposed at positions opposite to said cold cathode devices;

wherein said modulation means is voltage amplitude modulation means having a non-linear input/output characteristic responsive to input image data, and wherein said voltage amplitude modulation unit further comprises means for outputting a predetermined voltage independent of the input image data.

20. A display device comprising:

a display panel; and a modulation circuit for supplying a modulation signal to said display panel, wherein said modulation circuit inputs M bits image data, and has an amplitude modulation circuit inputting M bits and a pulse width control circuit for controlling a pulse width of a modulation signal to be outputted from said modulation circuit.

21. The display device according to claim 20, wherein said display panel has a plurality of wirings, and said modulation circuit supplies the modulation signal to each of said wirings.

22. A display device according to claim 20, wherein said pulse width controlling circuit limits the pulse width of the modulation signal, when the image data is a small value.

23. A display device comprising:

a display panel; and a modulation circuit for supplying a modulation signal to the display panel, wherein the modulation circuit operates such that a relation between an increasing in a data inputted into the modulation circuit and an increasing in an absolute value of an output voltage from the modulation circuit is non-linear.

24. A display device according to claim 23, wherein said modulation circuit comprises a plurality of amplitude modulation circuits having different slopes of characteristics lines showing a relation between the input data and the output voltage.

25. A display device according to claim 23, wherein said display panel has a plurality of wirings, and said modulation circuit supplies the modulation signal to each of the wirings.

* * * * *

UNITED STATES PATENT AND TRADEMARK OFFICE

CERTIFICATE OF CORRECTION

PATENT NO. : 6,653,794 B2
DATED : November 25, 2003
INVENTOR(S) : Osamu Sagano et al.

It is certified that error appears in the above-identified patent and that said Letters Patent is hereby corrected as shown below:

Title page,
Item [56], References Cited, OTHER PUBLICATIONS,
"R. Meyer, et al.," should read -- R. Meyer et al., --;
"W.P. Dyke, et al.," should read -- W.P. Dyke et al., --;
"C.A. Spindt, et al.," should read -- C.A. Spindt et al. --; and "*Thin-film*" should read -- *Thin-film Field* --.

Drawings
Figures 19-24 should be deleted to appear as per attached figures 19-24.

Column 1,
Line 40, "Hartwell, et al.," should read -- Hartwell et al., --.

Column 2,
Line 7, "emission"," should read -- Emission", --;
Line 8, "Advance in Electron Physics, 8," should read -- Advances in Electronics and Electron Physics, 3, --;
Line 9, "thin-film field emission cathodes" should read -- Thin-film Field Emisssion Cathodes --;
Line 10, "molybdenum cones"," should read -- Molybdenum Cones", --;
Line 14, "Spindt, et al." should read -- Spindt et al., -- and
Line 27, "tunnel-emission" should read -- Tunnel-Emission --.

Column 3,
Line 22, "R. Meyer, et al." should read -- R. Meyer et al. --.

Column 9,
Line 55, "an" should read -- a --.

Column 13,
Line 10, "between O" should read -- between 0 --; and "an" should read -- a --; and
Line 16, "reverse," should read -- reversed, --.

Column 14,
Lines 7, 8 and 9, "an" should read -- a --; and
Line 15, "reverse" should read -- reversed --.

UNITED STATES PATENT AND TRADEMARK OFFICE

CERTIFICATE OF CORRECTION

PATENT NO. : 6,653,794 B2
DATED : November 25, 2003
INVENTOR(S) : Osamu Sagano et al.

It is certified that error appears in the above-identified patent and that said Letters Patent is hereby corrected as shown below:

Column 15,
Line 31, “an” should read -- a --.

Column 16,
Line 65, “(Di≦Dth)” should read -- (Di≧Dth) --.

Column 17,
Line 16, “there are” should read -- it is --.

Column 18,
Line 24, “converters,” should read -- converter --.

Column 19,
Line 8, “there” should read -- it --.

Signed and Sealed this

Second Day of November, 2004

JON W. DUDAS
*Director of the United States Patent and Trademark Office*

-- FIG. 23 PRIOR ART --
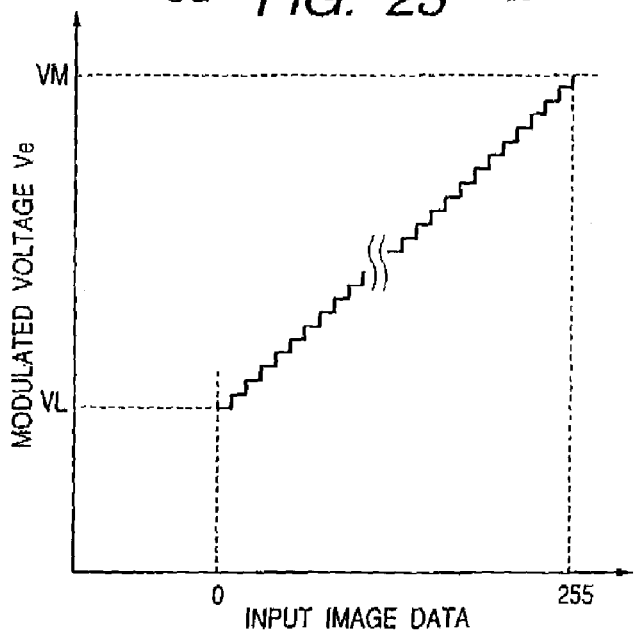
-- FIG. 24 PRIOR ART --
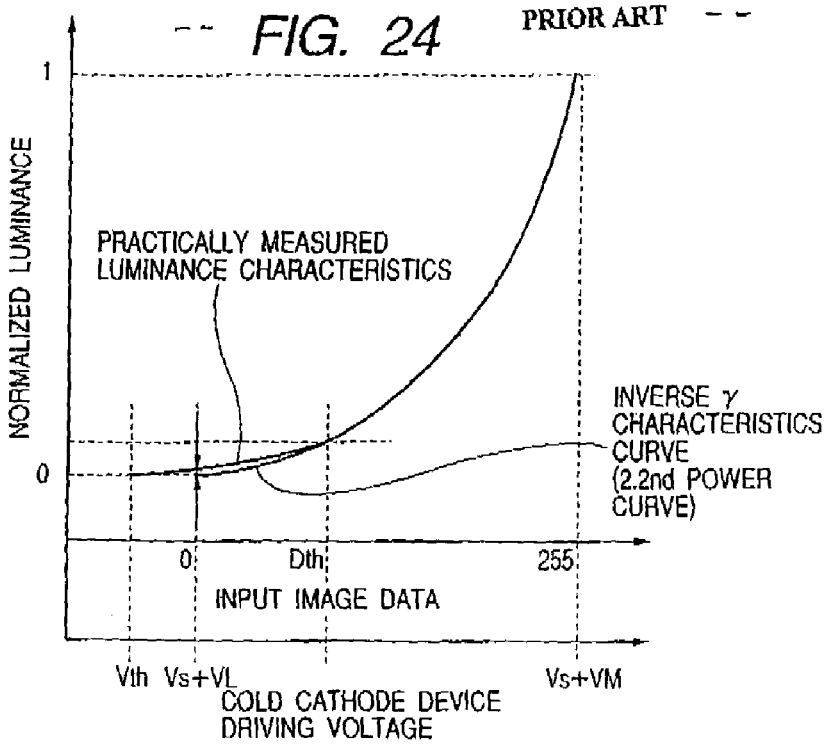

Figure 23:
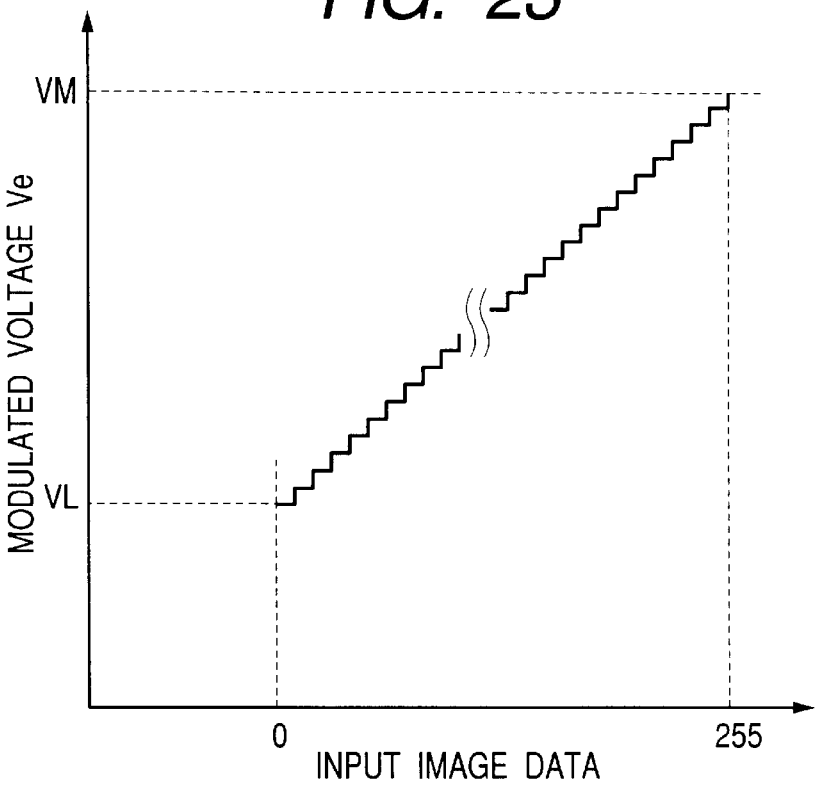
FIG. 23 is a diagram for explanation of a problem to be solved by the invention.
Figure 24:
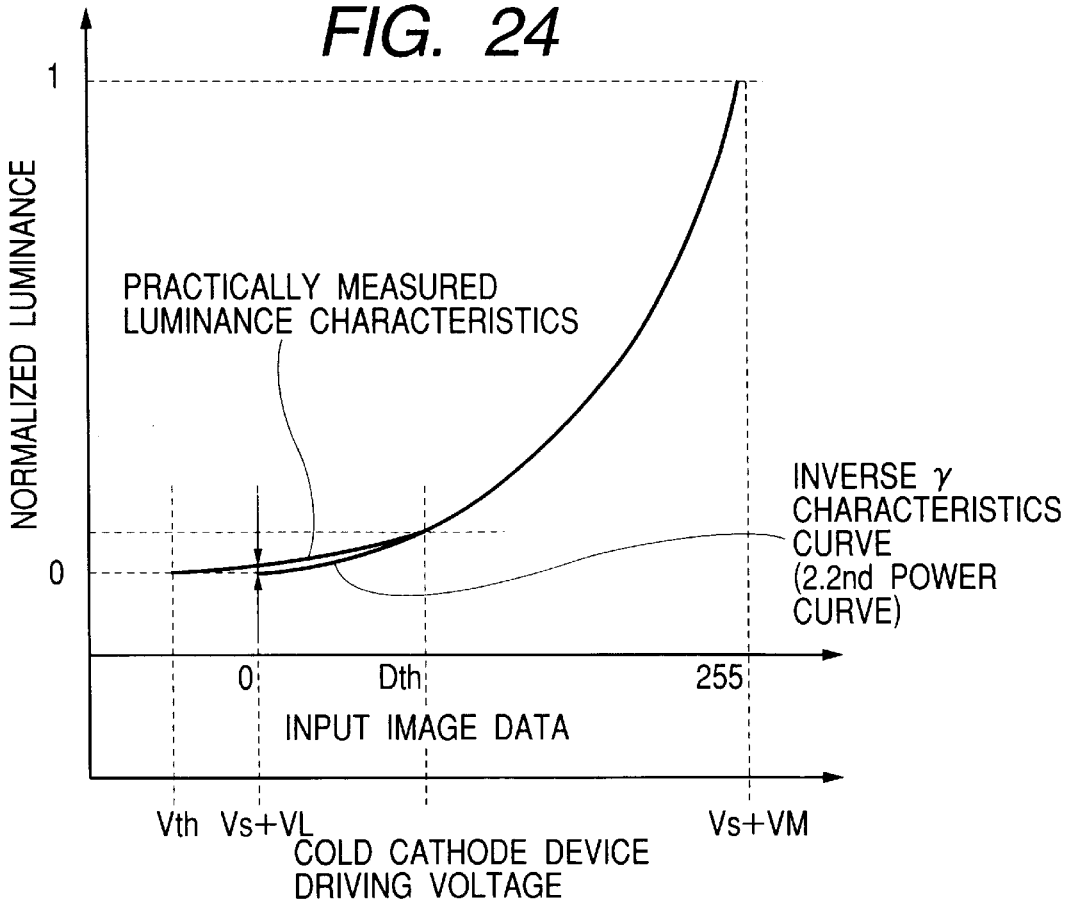
FIG. 24 is a diagram for explanation of a problem to be solved by the invention.
Figure 19:
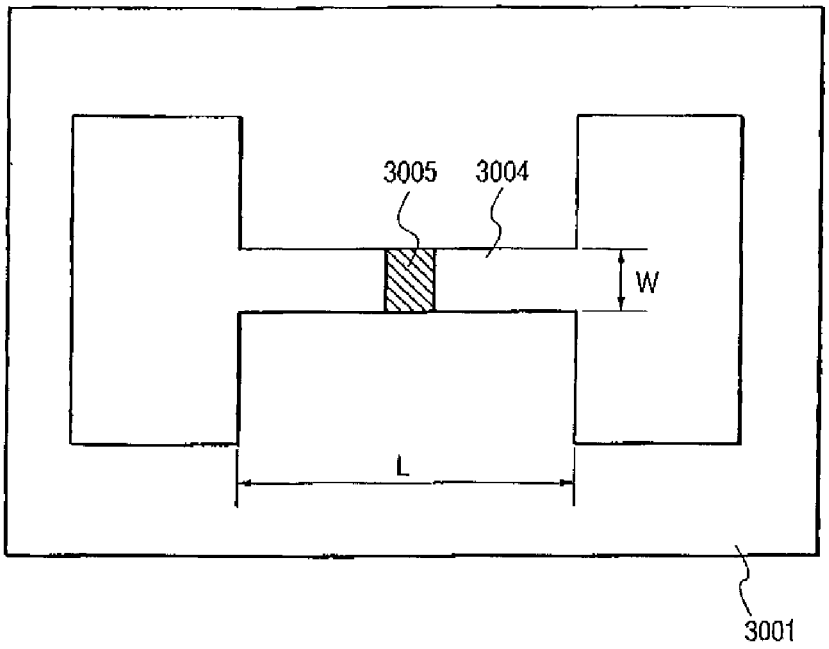
FIG. 19 PRIOR ART
Figure 20:
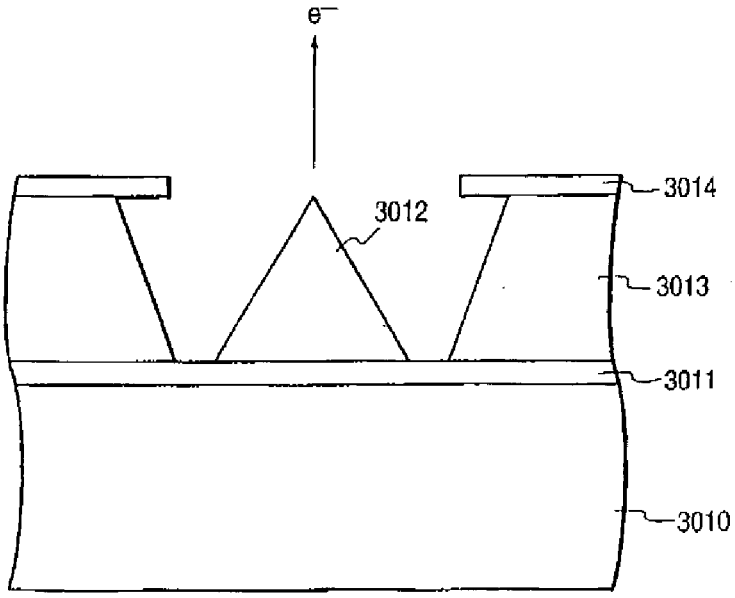
FIG. 20 PRIOR ART
Figure 21:
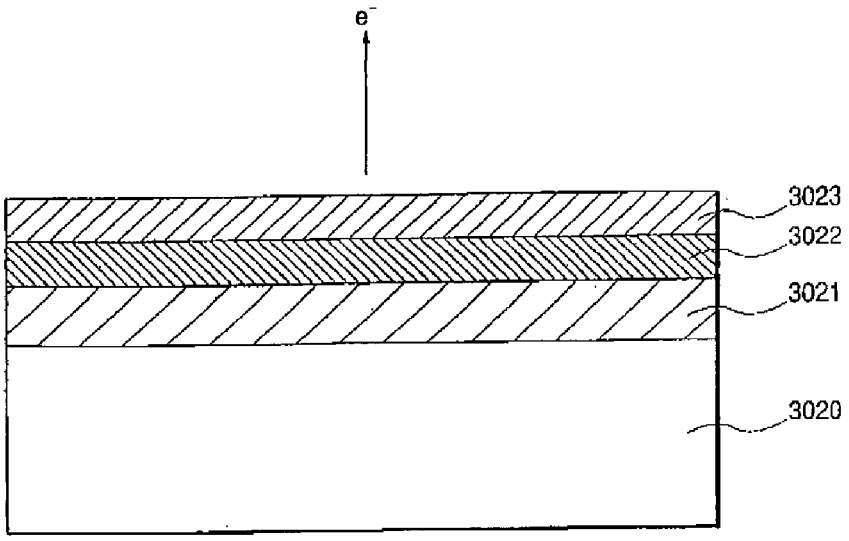
Figure 22:
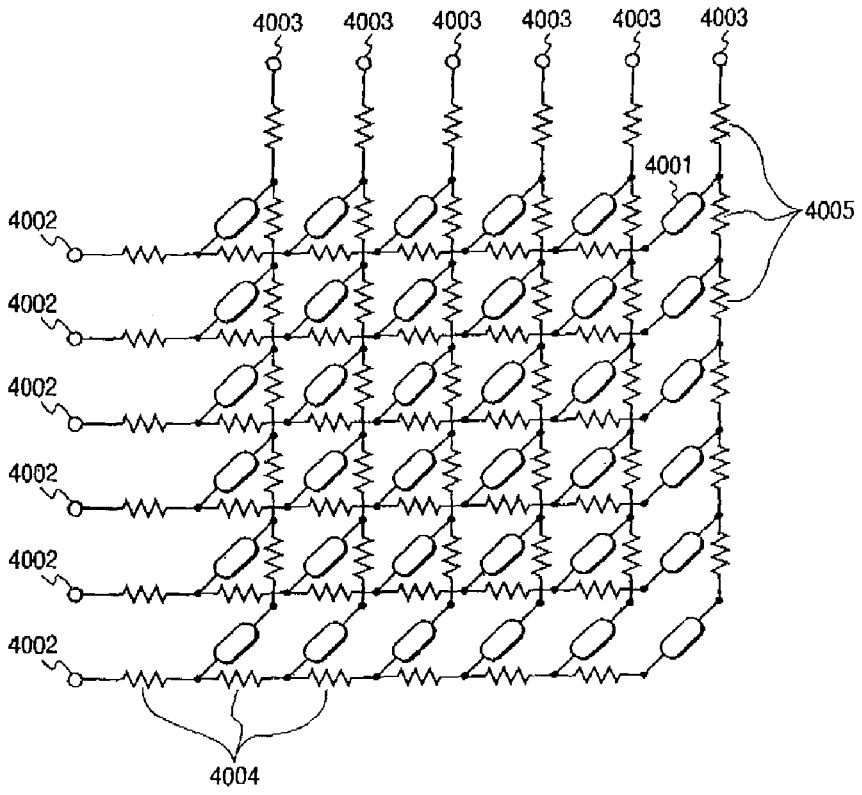
PRIOR ART FIG. 22